US010873176B2

(12) United States Patent
Deguchi

(10) Patent No.: US 10,873,176 B2
(45) Date of Patent: Dec. 22, 2020

(54) SPARK PLUG AND METHOD OF PRODUCING THE SAME

(71) Applicant: DENSO CORPORATION, Kariya (JP)

(72) Inventor: Masataka Deguchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/812,594

(22) Filed: Mar. 9, 2020

(65) Prior Publication Data

US 2020/0303905 A1 Sep. 24, 2020

(30) Foreign Application Priority Data

Mar. 21, 2019 (JP) ..... 2019-053957

(51) Int. Cl.
*H01T 13/36* (2006.01)
*H01T 21/02* (2006.01)

(52) U.S. Cl.
CPC ..... *H01T 13/36* (2013.01); *H01T 21/02* (2013.01)

(58) Field of Classification Search
None
See application file for complete search history.

(56) References Cited

U.S. PATENT DOCUMENTS 1,485,275 A * 2/1924 Koerber ..... H01T 13/36 174/152 S
2,221,537 A * 11/1940 Buening ..... H01T 13/36 313/144
7,215,069 B2 * 5/2007 Suzuki ..... H01T 13/36 313/143
8,294,347 B2 * 10/2012 Nakamura ..... H01T 13/20 313/144
9,276,383 B2 * 3/2016 Ozeki ..... H01T 13/36
9,819,156 B2 * 11/2017 Krebs ..... H01T 13/36
10,186,844 B2 * 1/2019 Kobayashi ..... H01T 13/36
2013/0015756 A1 1/2013 Yamada et al.

* cited by examiner

*Primary Examiner* — Vip Patel
(74) *Attorney, Agent, or Firm* — Nixon & Vanderhye, P.C.

(57) ABSTRACT

A spark plug has a housing of a cylindrical shape, an insulator of a cylindrical shape, and a packing. The housing has a housing facing surface. The insulator has an insulator facing surface and is supported in the housing. The packing has an insulator side contact surface which is in contact with the insulator facing surface. The packing is arranged between the housing facing surface and the insulator facing surface to face both the housing facing surface and the insulator facing surface. The packing has proximal inner circumferential surfaces formed adjacent with the inner periphery side of the insulator side contact surface. Each of the proximal inner circumferential surfaces has a curved shape smoothly connected to the insulator side contact surface of the packing.

13 Claims, 17 Drawing Sheets

SPARK PLUG AND METHOD OF PRODUCING THE SAME

CROSS-REFERENCE TO RELATED APPLICATION

This application is related to and claims priority from Japanese Patent Application No. 2019-53957 filed on Mar. 21, 2019, the contents of which are hereby incorporated by reference.

TECHNICAL FIELD

The present disclosure relates to spark plugs and methods of producing a spark plug.

BACKGROUND

A known spark plug has a housing and an insulator. The housing is made of low carbon steel and has a cylindrical shape. The insulator is made of alumina and has a cylindrical shape. The insulator is arranged inside the housing. The housing has a stepwise structure in which a stepwise shape is formed on an inner periphery side of the housing to be projected from an inner circumferential wall. The insulator is supported by a proximal end side surface of the stepwise shape through a packing member. The packing member is made of metal and has a ring shape. The packing member allows a chamber between the housing and the insulator to maintain its air tightness.

The spark plug previously described has pointed corners formed on the inner periphery side and an outer periphery side of the surface which are in contact with the insulator at the packing member side. This structure may cause generation of cracks in the insulator due to a large force applied from the pointed corners to the insulator side. In particular, cracks are generated in the insulator from the outer circumferential surface of the insulator to the diameter direction of the spark plug due to the magnitude of force applied from the pointed corners at the inner periphery side of the packing to the insulator. This often causes the insulator to be broken.

SUMMARY

It is desired for the present disclosure to provide a spark plug having a housing, an insulator and a packing. The housing has a cylindrical shape. The housing has a housing facing surface. The insulator has a cylindrical shape. The insulator has an insulator facing surface. The insulator is supported in the housing. The packing has an insulator side contact surface formed in contact with the insulator facing surface of the insulator. The packing is arranged between the housing facing surface of the housing and the insulator facing surface of the insulator so as to face both the housing facing surface and the insulator facing surface. The packing has proximal inner circumferential surfaces formed adjacent with the inner periphery side of the insulator side contact surface. Each of the proximal inner circumferential surfaces has a curved shape which is smoothly connected to the insulator side contact surface of the packing.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
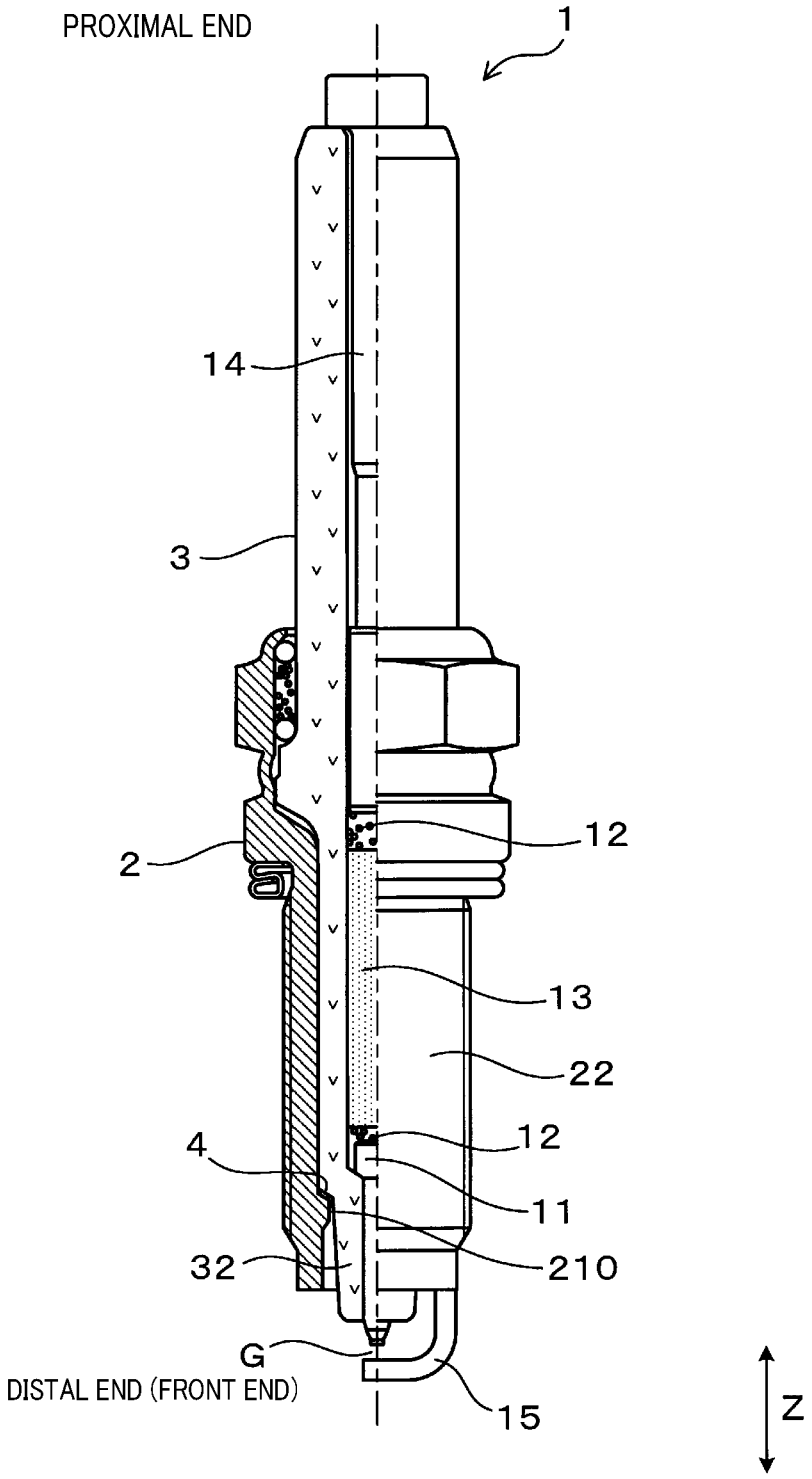
FIG. 1 is a view showing a half cross section of a spark plug according to a first exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of a spark plug according to a first exemplary embodiment of the present disclosure and of a method of producing the spark plug according to the first exemplary embodiment with reference to FIG. 1 to FIG. 10.

Figure 2:
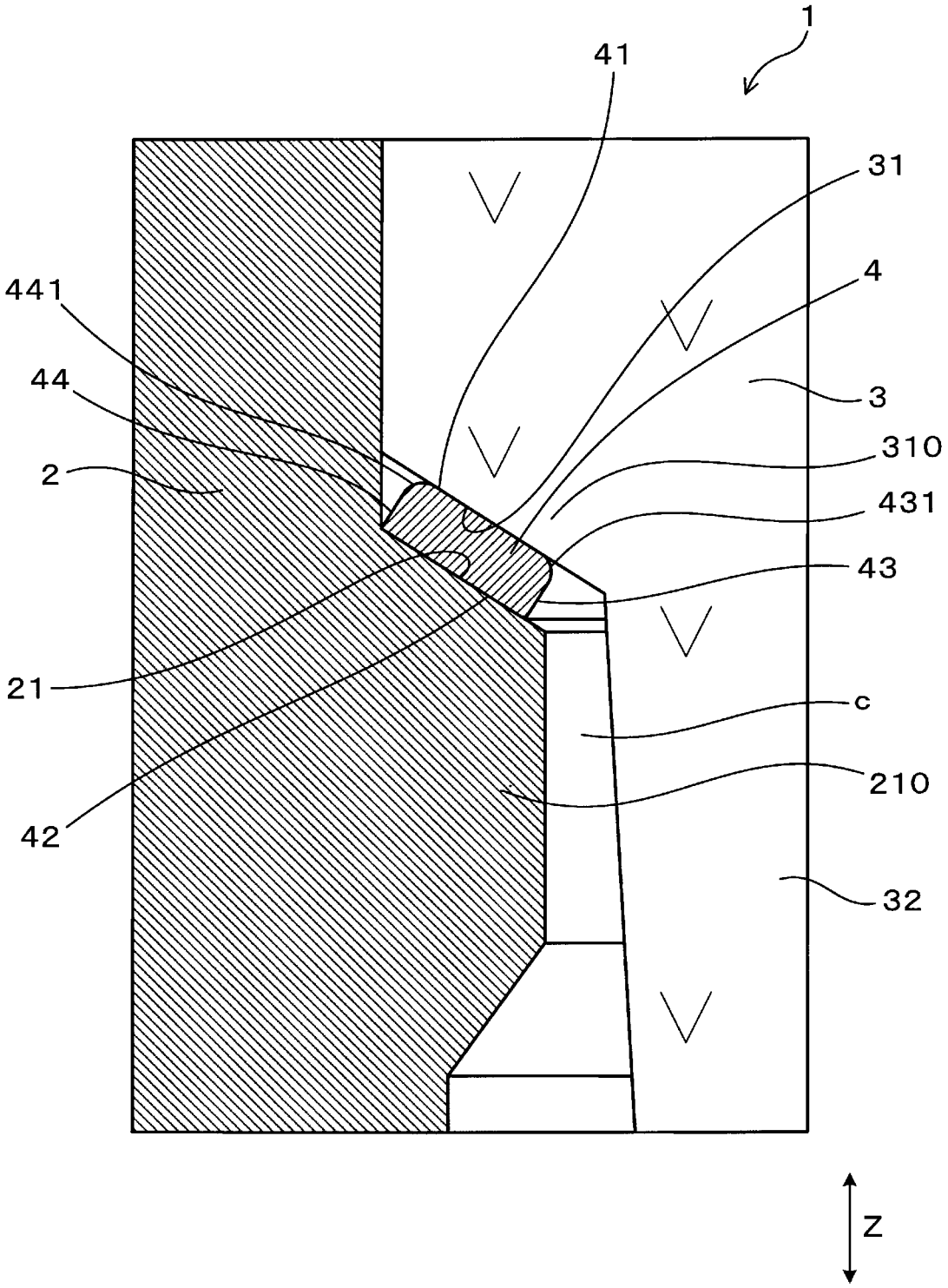
FIG. 2 is an enlarged view of a surrounding part of a packing in the spark plug shown in FIG. 1.

FIG. 1 is a view showing a half cross section of the spark plug 1 according to the first exemplary embodiment of the present disclosure. FIG. 2 is an enlarged view of a surrounding part of a packing 4 in the spark plug 1 shown in FIG. 1.

As shown in FIG. 1 and FIG. 2, the spark plug 1 according to the first exemplary embodiment has a housing 2 and an insulator 3.

As shown in FIG. 1, the housing 2 has a cylindrical shape. The insulator 3 is arranged inside the housing 2. As shown in FIG. 2, the packing 4 is supported by a housing facing surface 21 of the housing 2 and an insulator facing surface 31 of the insulator 3, where the housing facing surface 21 of the housing 2 is arranged facing the insulator facing surface 31 of the insulator 3.

The packing 4 has an insulator side contact surface 41 which is formed in contact with the insulator facing surface 31 of the insulator 3. The packing 4 has proximal inner circumferential surfaces 431 formed adjacently at the inner periphery side of the insulator side contact surface 41 of the packing 4. Each proximal inner circumferential surface 431 has a curved surface which is smoothly fitted to the insulator side contact surface 41 of the packing 4.

A description will now be given of a detailed structure of the spark plug 1 according to the first exemplary embodiment.

The spark plug 1 according to the first exemplary embodiment is applied to internal combustion engines mounted on motor vehicles, and co-generation systems. The spark plug 1 according to the first exemplary embodiment is used as an ignition device to ignite a combustion in an internal combustion engine. One side of the spark plug 1 according to the first exemplary embodiment is connected to an ignition coil (not shown) in a plug axial direction Z. The other side of the spark plug 1 is arranged in the combustion chamber of the internal combustion engine.

A central axis of the spark plug 1 will be referred to as the plug central axis. A proximal end side of the spark plug 1 is connected to the ignition coil (not shown), and a distal end side (or a front end side) of the spark plug 1 is arranged inside the combustion chamber of the internal combustion engine. A circumferential direction of the spark plug 1 will be referred to as the plug circumferential direction. A radial direction of the spark plug 1 will be referred to as the plug radial direction.

The housing 2 has a cylindrical shape and is made of heat resistance metal material such as iron, nickel, iron nickel alloy, stainless steel, etc. As shown in FIG. 1, the housing 2 supports the insulator 2 arranged in an inside chamber at the inner periphery side of the housing 2.

An attachment screw part 22 is formed at the distal end side of the housing 2. The attachment screw part 22 of the housing 2 is screwed into a female screw hole formed in a plug hole of an engine head of the internal combustion engine. This allows the spark plug 1 to be mounted on the internal combustion engine. That is, the spark plug 1 is mounted on the engine head of the internal combustion engine when the attachment screw part 22 is engaged with the female screw part of the plug hole. The distal end side of the spark plug 1 is arranged inside the combustion chamber of the internal combustion engine.

As shown in FIG. 1 and FIG. 2, the housing has a projection part 210 which is projected from a part of the inner circumferential surface of the housing in the inner periphery side.

The projection part 210 is formed at the distal end side of the housing 2. That is, the projection part 210 is formed at the inner periphery side of the attachment screw part 22. The projection part 210 has a ring shape formed on the overall inner circumferential surface of the housing 2. As shown in FIG. 1, the projection part 210 has the minimum inner diameter of the housing 2.

As shown in FIG. 2, the proximal end side surface of the projection part 210 corresponds to the housing facing surface 21 which will be explained later.

The housing facing surface has a taper shape which is tapered in the inner periphery side along the distal end side of the housing 2 in the spark plug axial direction Z. As shown in FIG. 2, the insulator 2 is supported by the housing facing surface 21 of the housing 2 through the packing 2.

The insulator 3 has a cylindrical shape made of insulation member such as alumina. As shown in FIG. 1, the insulator 3 is supported by the housing 2 so that the distal end side and the proximal end side of the insulator 3 are projected from the housing 2 viewed along the plug axial direction Z.

An insulator leg part 32 is formed at the distal end side of the insulator 3 so that an outer diameter of the insulator leg part 32 is reduced in the distal end side of the insulator 2.

The distal end side part of the insulator leg part 32 is projected from the distal end side of the housing 2. An insulator stepwise part 310 is formed so that the insulator leg part 32 is arranged adjacent to a proximal end part of the insulator leg part 32.

The insulator stepwise part 310 has a diameter which increases in the proximal end side of the spark plug 1 in the plug axial direction Z. The outer circumferential surface of the insulator stepwise part 310 forms the insulator facing surface 31 of the insulator 3.

The insulator facing surface 31 has a taper shape which is tapered outwardly from the insulator leg part 32 in the proximal end side of the insulator 3. The insulator facing surface 31 of the insulator 3 is arranged facing the housing facing surface 21 substantially parallel from each other.

As shown in FIG. 2, the inner circumferential edge part of the insulator facing surface 31 is arranged slightly and inwardly projecting from the projection part 210 formed at the distal end side of the housing 2.

The insulator leg part 32 is formed from the inner circumferential edge part to the distal end side of the insulator 3. This arrangement provides a gap c between the projection part 210 of the housing 2 and the insulator leg part 32 in a plug radial direction which is perpendicular to the plug axial direction Z (see FIG. 2).

The packing 4 is fitted to the gap between the insulator facing surface 31 of the insulator 3 and the housing facing surface 21 of the housing 2. That is, the packing 4 is supported by the housing 2 and the insulator 3.

Figure 3:
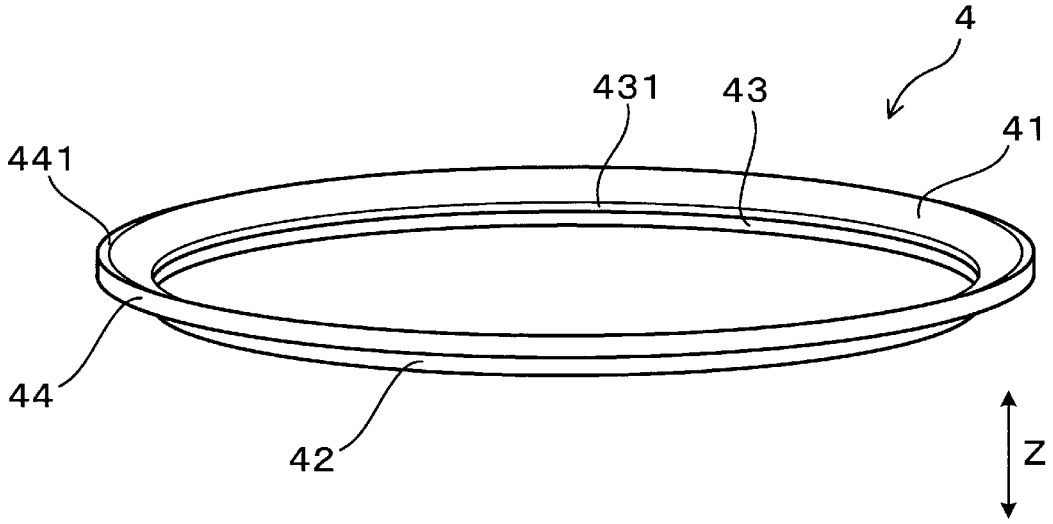
FIG. 3 is a perspective view of the packing in the spark plug according to the first exemplary embodiment shown in FIG. 1.

FIG. 3 is a perspective view of the packing 4 in the spark plug 1 according to the first exemplary embodiment shown in FIG. 1. As shown in FIG. 3, the packing 4 is produced by forming metal material in a ring shape. For example, it is possible to punch a cold reduced carbon steel sheet (SPCD of the Japanese Industrial Standard). A detailed method of producing the packing 4 will be explained later.

As shown in FIG. 2, the packing 4 is formed to be fitted in a gap formed between the insulator facing surface 31 and the housing facing surface 21 which face from each other in the normal direction of the insulator facing surface 31 and the insulator leg part 32.

The packing 4 is not arranged at an inner periphery side of the insulator facing surface 31. In addition, the packing 4 is not arranged in the gap c formed between the projection part 210 of the housing 2 and the insulator 3. Further, the packing 4 is not in contact with the side surface of the insulator leg part 32 of the insulator 3.

When the packing 4 is arranged in the gap c shown in FIG. 2, the packing 4 presses the insulator 3 in the radial direction of the spark plug 1. This arrangement reduces a strength of the insulator 3 in the spark plug 1. Accordingly, it is preferable to avoid the packing 4 from being arranged in the gap c.

The packing 4 has a taper shape which is tapered in the distal end side thereof in the inner periphery side so as to fit the insulator facing surface 31 and the housing facing surface 21.

The packing 4 has the insulator side contact surface 41, a housing side contact surface 42, an inner periphery side surface 43 and an outer periphery side surface 44.

As previously described, the insulator side contact surface 41 is arranged in contact with the insulator facing surface 31 of the insulator 3. As shown in FIG. 2, the housing side contact surface 42 is arranged in contact with the housing facing surface 21 of the housing 2. The inner circumferential end of the insulator side contact surface 41 is connected to the inner circumferential end of the housing side contact surface 42 through the inner periphery side surface 43. The outer circumferential end of the insulator side contact surface 41 is connected to the outer circumferential end of the housing side contact surface 42 through the outer periphery side surface 44.

As previously described, the proximal inner circumferential surface 431 is formed adjacent to the inner periphery side of the insulator side contact surface 41 of the packing. The proximal inner circumferential surface 431 has a curved surface capable of being smoothly fitted to the insulator side contact surface 41 of the packing 4.

The proximal inner circumferential surface 431 is formed on the end part of the insulator side contact surface 41 at the inner periphery side surface 43 side. As shown in FIG. 2, the proximal inner circumferential surface 431 has a curved surface of a chamfer at the proximal end side of the packing 4 in a diagonally inner circumferential direction. The proximal inner circumferential surface 431 is formed on the packing 4 along the overall plug circumferential direction. On a cross section of the packing 4 along the central axis of the spark plug 1 and is parallel to the plug axial direction Z, the proximal inner circumferential surface 431 has a curvature radius of not less than 5 μm.

The packing 4 further has a proximal outer circumferential surface 441 formed adjacently at the outer periphery side of the insulator side contact surface 41. The proximal outer circumferential surface 441 has a curved surface which is smoothly connected to the insulator side contact surface 41.

The proximal outer circumferential surface 441 in the outer periphery side surface 44 is formed at the end part of the insulator side contact surface 41. The proximal outer circumferential surface 441 has a curved surface of a chamfer at the proximal end side of the packing 4 in a diagonally outer circumferential direction.

The proximal outer circumferential surface 441 is formed on the packing 4 along the overall plug circumferential direction. On a cross section of the packing 4 along the central axis of the spark plug 1 and is parallel to the plug axial direction Z, the proximal outer circumferential surface 441 has a curvature radius of not less than 5 μm.

Figure 4:
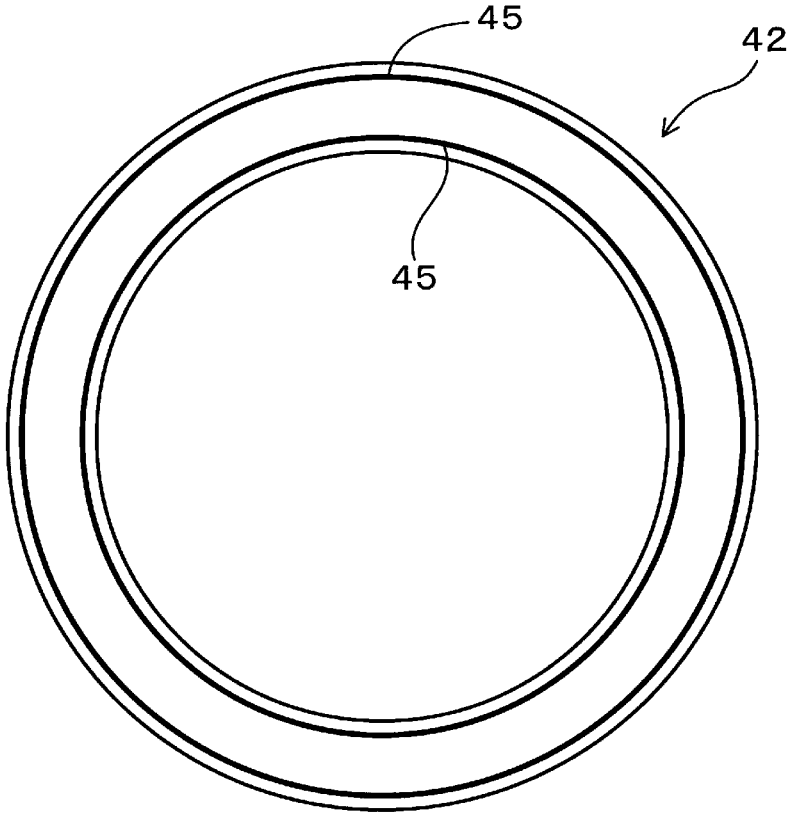
FIG. 4 is a schematic view showing a housing side contact surface at a housing side of the packing shown in FIG. 3.

FIG. 4 is a schematic view showing the housing side contact surface 42 at the housing side of the packing 4 shown in FIG. 3. As shown in FIG. 4, a burr line 45 is formed at the inner circumferential edge part and the outer circumferential edge part of the housing side contact surface 42 of the packing 4 along the plug circumferential direction.

The burr line 45 has been formed on the packing 4 before the packing 4 is assembled with the spark plug 1. Press burrs 401 shown in FIG. 7 projecting in the distal end side of the packing 4 are deformed and crushed by the housing facing surface 21 when the packing 4 is assembled with the spark plug 1.

When viewed from the distal end side, the burr line 45 in the packing 4 assembled with the spark plug 1 has a circular shape along the overall circumferential in the plug circumferential direction. The formation of the burr line 45 in the packing 4 will be explained later.

It is accordingly possible to detect the burr line 45 formed in the packing 4 based on the presence of the burr line 45 of the packing 4 assembled with the spark plug 1.

It is possible to recognize that the packing 4 has been produced from a plate member 400 by the punching step which has punched the other parts in the plate member 400, excepting for the part forming the packing 4, in the direction to which the press burrs project.

As shown in FIG. 1, a central electrode 11, a glass seal 12, a resistance 13 and a terminal fitting 14 are arranged inside the insulator 3. The central electrode 11 has a cylindrical shape made of nickel base alloy. In particular, a metal material having a superior thermal conductivity such as Cu, etc. is arranged in the central electrode 11. The central electrode 11 is arranged projecting from the insulator 3 in the distal end side of the spark plug 1. The resistance 13 is arranged at the proximal end side of the central electrode 11 through the glass seal 12 in the insulator 3.

The resistor 13 is produced by heating and sealing a resistance composite of glass power and a resistance material such as carbon or ceramics powder. It is acceptable to insert a cartridge type resistor as the resistor 13 into the insulator 3.

The glass seal 12 is made of copper glass produced by mixing copper powder into a glass member. The terminal fitting 14 is arranged at the proximal end side of the resistor 13 in the insulator 3 through the glass seal 12 made of copper glass. For example, the terminal fitting 14 is made of iron alloy. The spark plug 1 is electrically connected to the ignition coil (not shown) through the terminal fitting 14.

A ground electrode 15 is connected to a distal end surface (or a front end surface) of the housing 2. A discharge gap G is formed between the central electrode 11 and the ground electrode 15. A part of the ground electrode 15 is arranged facing the distal end surface of the central electrode 11 in the plug axial direction Z. That is, the discharge gap G is formed between the distal end surface of the central electrode 11 and the ground electrode 15 in the plug axial direction Z. A spark discharge is created in the discharge gap G of the spark plug 1 so as to ignite a fuel mixture in the combustion chamber of the internal combustion engine.

A description will be given of the method of producing the spark plug 1 according to the first exemplary embodiment with reference to FIG. 5 to FIG. 9.

First, a description will now be given of the method of producing the packing 4 with reference to FIG. 5 to FIG. 7.

Figure 5:
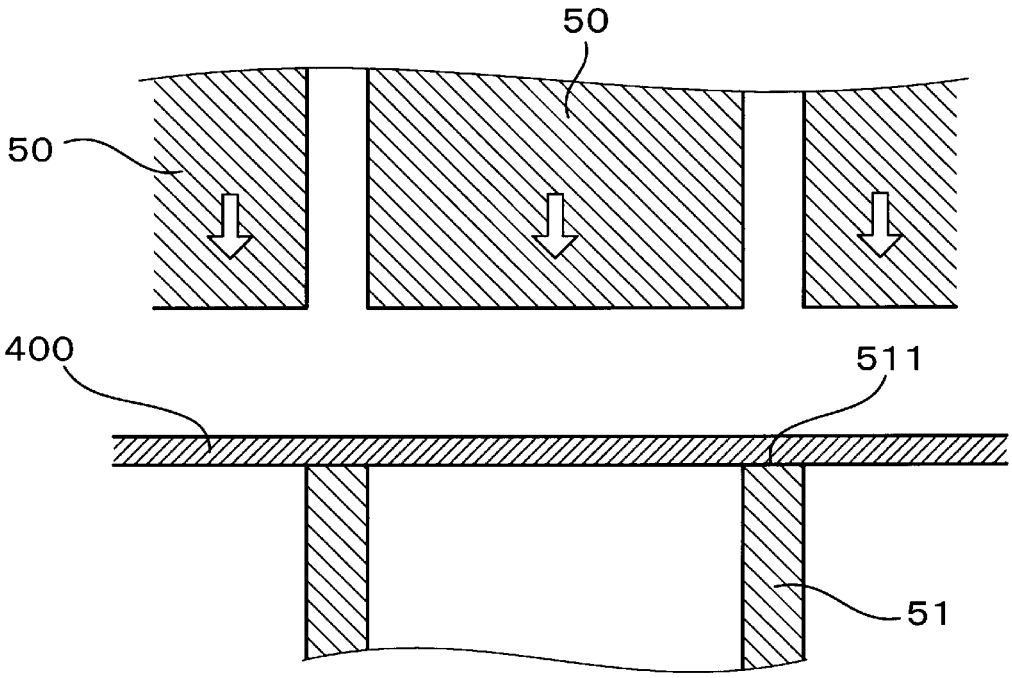
FIG. 5 is a view showing a method of producing a packing according to the first exemplary embodiment, in particular, showing a schematic cross section of a structure in which a plate member is arranged on a die to produce the packing.

FIG. 5 is a view showing the method of producing the packing 4 in the spark plug 1 according to the first exemplary embodiment. In particular, FIG. 5 shows a schematic cross section of a structure in which the plate member 400 is arranged on a die 51 to produce the packing 4. As shown in FIG. 5, a punching step punches a plate member 400 so as to produce the packing 4. In more detail, the punching step uses a punching tool 50 and a cylindrical die 51 shown in FIG. 5. In the punching step shown in FIG. 5, the plate member 400 is arranged on a mounting surface 511 at the end of the cylindrical die 51. The mounting surface 511 of the die 51 has a circular plate shape.

Figure 6:
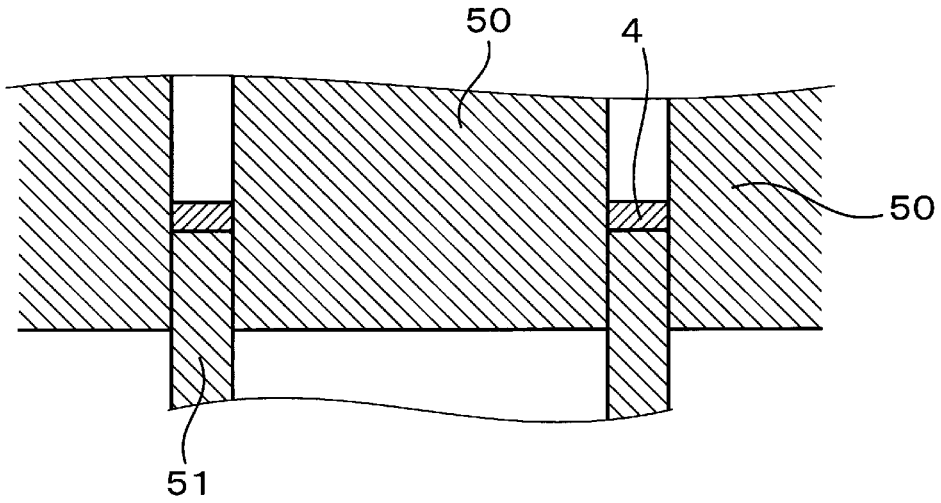
FIG. 6 is a view showing the method of producing the packing according to the first exemplary embodiment, in particular, showing a schematic cross section of the packing produced by punching the plate member.

FIG. 6 is a view showing the method of producing the packing 4 according to the first exemplary embodiment, in particular, showing a schematic cross section of the packing 4 produced by punching the plate member 400.

As shown in FIG. 5 and FIG. 6, the punching tool 50 punches the plate member 400 from the opposite surface of the die 51. The punching tool 50 punches the parts at the inner periphery side of the plate member 400 and the outer circumferential part of the plate member 400 viewed from the die 51. As previously described, the punching step produces the packing 4 having a ring shape.

Figure 7:
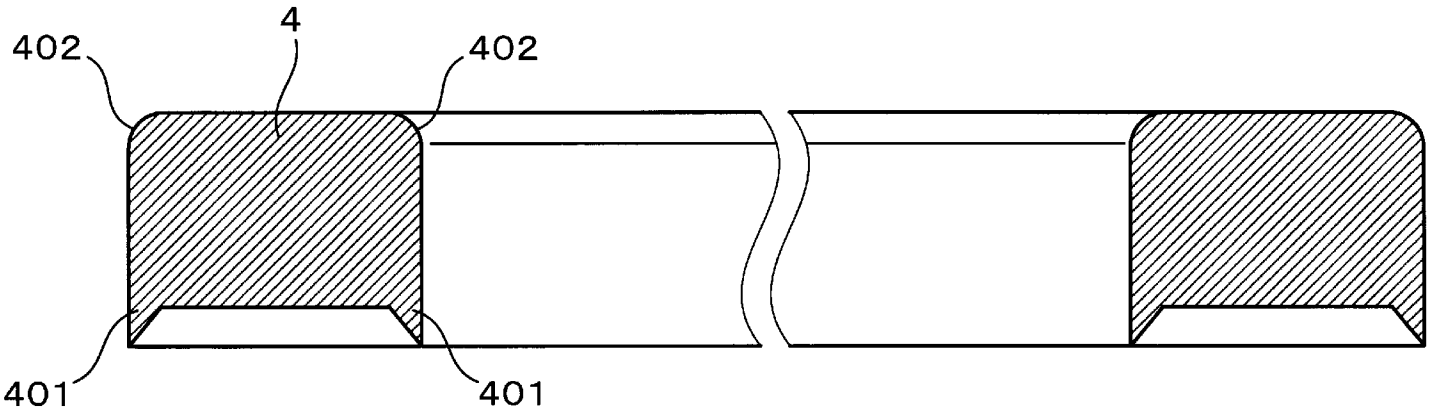
FIG. 7 is a view showing a cross section of the packing produced by the method shown in FIG. 6.

FIG. 7 is a view showing a cross section of the packing 4 produced by the method shown in FIG. 6. As shown in FIG. 7, press burrs 401 are formed at the inner circumferential edge and the outer circumferential edge around the overall circumferential of the packing 400 after the punching tool 50 punches the plate member 400. Further, as shown in FIG. 7, a press sagging 402 of a curved shape are also generated at the corners of the packing 4 opposite to the projection side of the press burrs 401 around the overall circumferential of the packing 4.

A description will be given of the method of assembling the packing 4 with the spark plug 1 with reference to FIG. 8 to FIG. 10.

Figure 8:
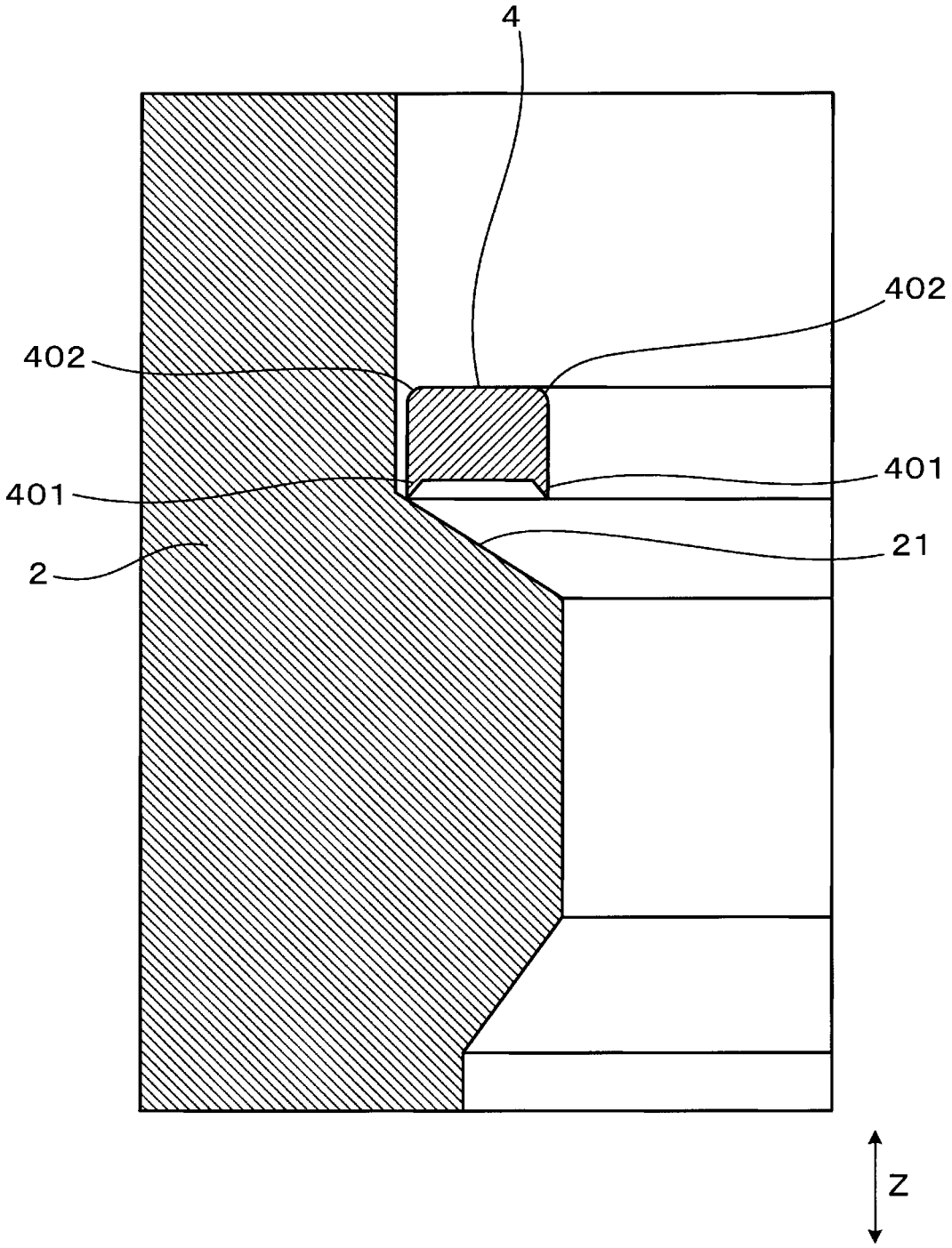
FIG. 8 is a view showing a method of producing the spark plug according to the first exemplary embodiment, in particular, showing a partially enlarged cross section of a structure in which the packing is assembled with the housing in the spark plug according to the first exemplary embodiment.

FIG. 8 is a view showing the method of producing the spark plug 1 according to the first exemplary embodiment. In particular, FIG. 8 showing a partially enlarged cross section of a structure in which the packing 4 is assembled with the housing 2 in the spark plug 1.

As shown in FIG. 8, the packing 4, which has been produced by the method previously described, is arranged on the housing facing surface 21 of the housing 2 so that the press burrs 401 are formed at the housing facing surface 21 side, and the press sagging 402 is formed at the opposite (i.e. in the proximal end side) of the housing facing surface 21.

Figure 9:
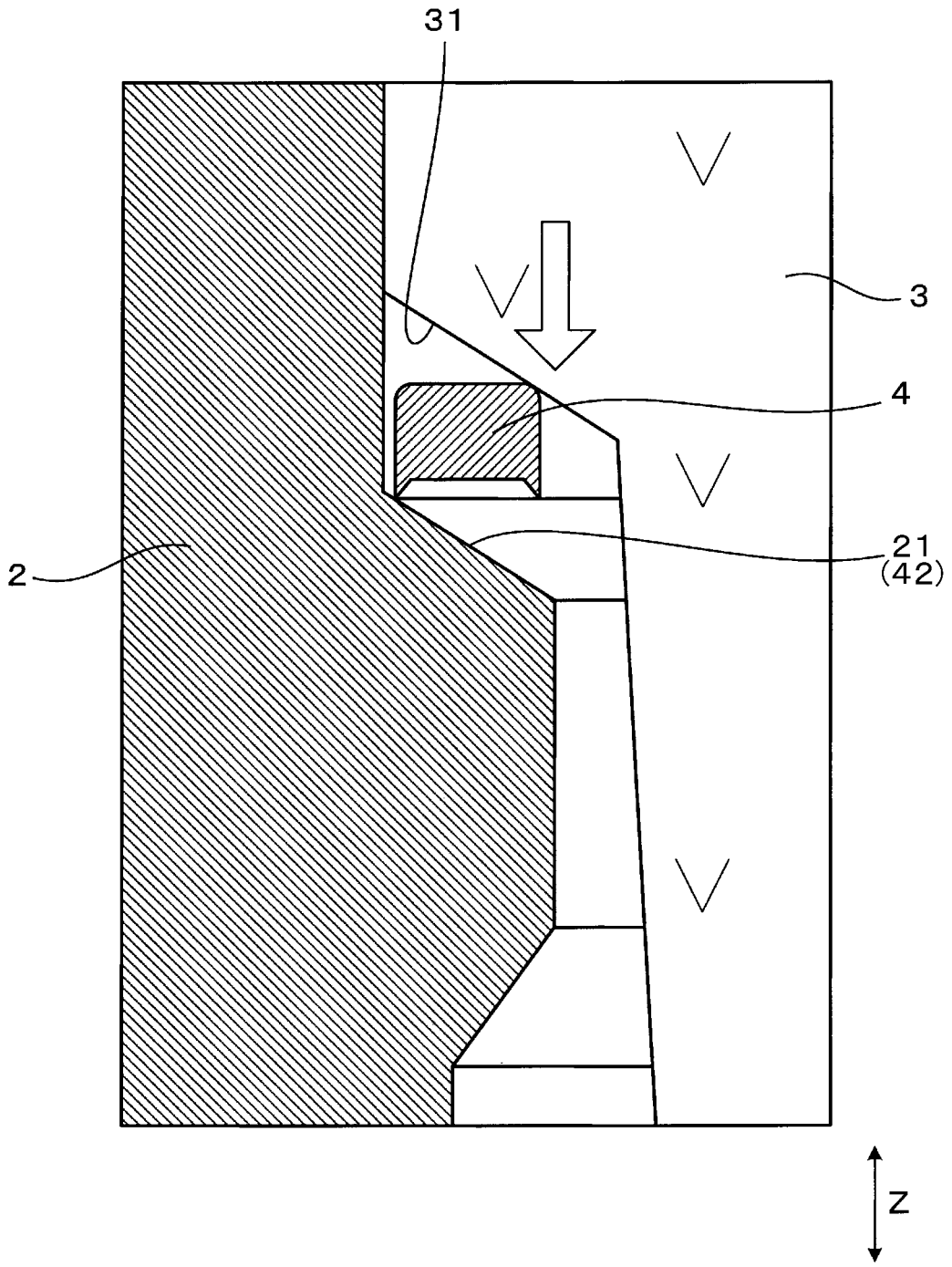
FIG. 9 is a view showing the method of producing the spark plug according to the first exemplary embodiment, in particular, showing a partially enlarged cross section of a structure in which the insulator is inserted into the housing in the spark plug according to the first exemplary embodiment.
Figure 10:
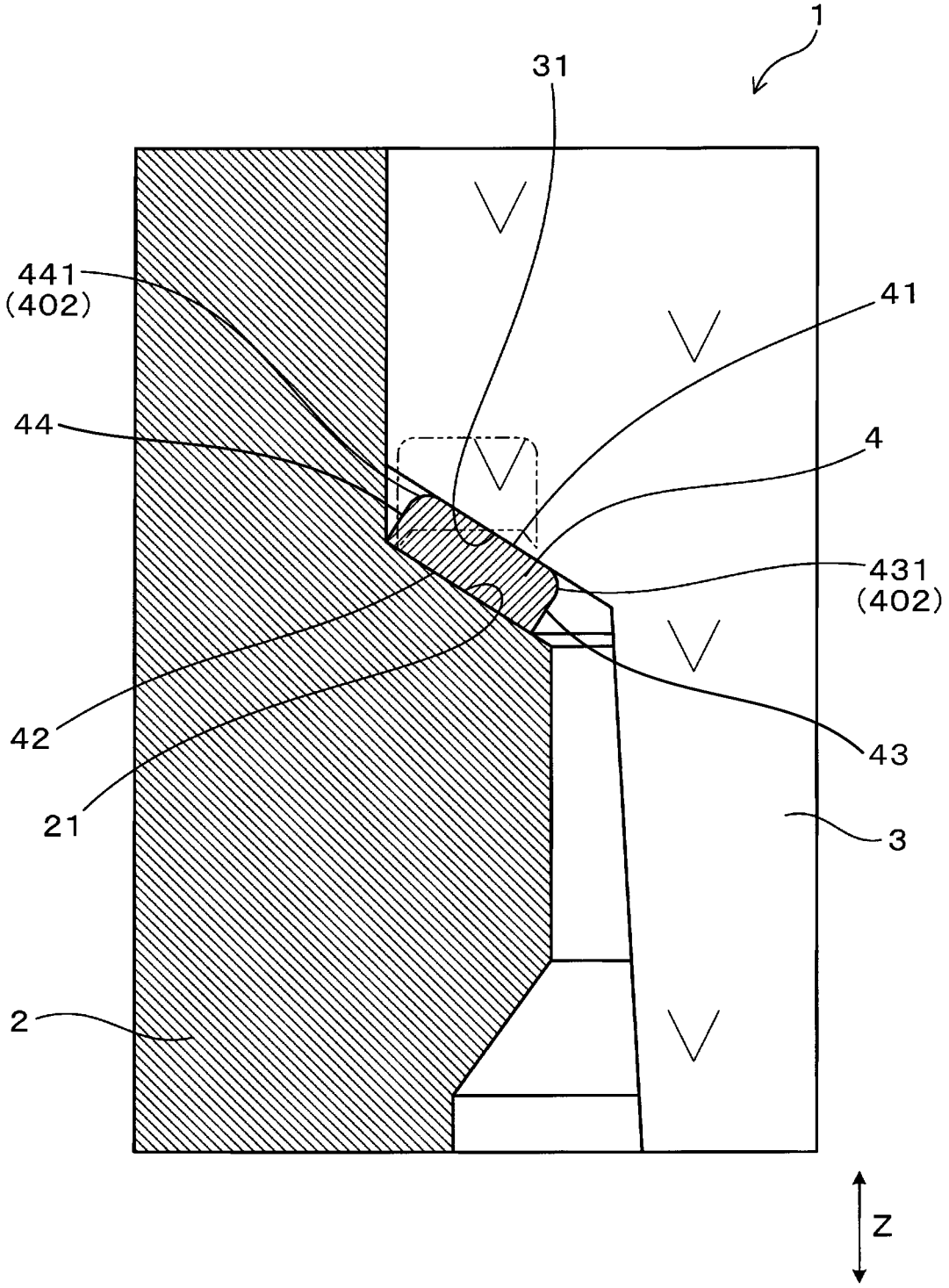
FIG. 10 is a view showing the method of producing the spark plug according to the first exemplary embodiment, in particular, showing a partially enlarged cross section of a structure in which the packing is arranged in and fitted to the gap between the housing and the insulator in the spark plug.

FIG. 9 is a view showing the method of producing the spark plug 1 according to the first exemplary embodiment. In particular, FIG. 9 shows a partially enlarged cross section of a structure in which the insulator 3 is inserted into the housing 2 in the spark plug 1 according to the first exemplary embodiment. FIG. 10 is a view showing the method of producing the spark plug 1 according to the first exemplary embodiment. In particular, FIG. 10 shows a partially enlarged cross section of a structure in which the packing 4 is arranged in and fitted to the gap between the housing 2 and the insulator 3 in the spark plug 1.

As shown in FIG. 9, the insulator 3 is inserted inside the housing 2 from the proximal end side of the housing 2 until the insulator facing surface 31 of the insulator 3 becomes in contact with the packing 4. After this, the insulator 3 is pressed to the housing 2 side in the distal end direction of the spark plug 1. This pressing deforms the shape of the packing 4, and the shape of the packing 4 tapers inwardly in the distal end side of the housing 2 along the insulator facing surface 31 of the insulator 3 and the housing facing surface 21 of the housing 2.

The insulator side contact surface 41 at the proximal end side of the packing 4 is in contact with the insulator facing surface 31 of the housing 3. The press sagging 402 adjacent to the inner periphery side of the insulator side contact surface 41 forms the proximal inner circumferential surface 431. The press sagging 402 adjacent to the outer periphery side of the insulator side contact surface 41 forms the proximal outer circumferential surface 441.

The press burr 401 formed at the distal end side of the packing 4 is pressed by the housing facing surface 21 of the housing 2. As shown in FIG. 4, the burr line 45 is formed around the inner circumferential edge and the outer circumferential edge of the housing side contact surface 42 of the packing 4.

As previously described, the packing 4 is assembled with the spark plug 1 and fitted between the housing 2 and the insulator 3.

A description will be given of behavior and effects of the spark plug 1 with the packing 4 and the method according to the first exemplary embodiment.

In the structure of the spark plug 1 according to the first exemplary embodiment, the proximal inner circumferential surface 431, formed adjacent to the inner periphery side of the insulator side contact surface 41 in the packing 4, has the curved surface which is smoothly connected to the insulator side contact surface 41. This structure makes it possible to reduce the magnitude of force applied to the insulator 3 to the insulator 3 from the inner periphery side of the insulator side contact surface 41 of the packing 4 through the insulator facing surface 31. Accordingly, this structure of the spark plug 1 makes it possible to suppress the insulator 3 from being broken due to progress of cracks from the insulator facing surface 31 in the central point of the spark plug 1 in the plug radial direction, i.e. in the radial direction of the spark plug 1.

On a cross section of the packing 4 which is in parallel with the plug axial direction Z which is on the central axis of the spark plug 1, each proximal inner circumferential surface 431 of the packing 4 has a curvature radius of not less than 5 μm. This structure makes it possible to smoothly connect the insulator side contact surface 41 to the proximal inner circumferential surface 431 in the packing 4. This structure more reduces the force applied from the packing 4 to the insulator 3. The experimental results regarding the force applied from the packing 4 to the insulator 3 will be explained later.

The burr line 45 is formed on the housing side contact surface 42 of the packing 4 along the inner circumferential edge part of the housing side contact surface 42. That is, the packing 4 is produced by the punching step previously described. Each proximal inner circumferential surface 431 having a curved surface is produced by using the press sag 402 formed at the location opposite to the press burr 401 (see FIG. 7). This makes it possible to easily produce the packing 4.

In addition to the proximal inner circumferential surfaces 431 of the packing 4, the proximal outer circumferential surface 441 also has a curved surface which is smoothly connected to the insulator side contact surface 41. This makes it possible to further reduce the magnitude of force applied from the packing 4 to the insulator 3.

In the method of producing the spark plug 1, the punching tool 50 punches the plate member 400 to produce the packing 4.

The packing 4 is arranged between the housing facing surface 21 of the housing 2 and the insulator facing surface 31 of the insulator 3 so that the press burr 401 of the packing 4 is formed at the housing facing surface 21 side and the press sagging 402 is formed at the insulator facing surface 31 side. This arrangement allows the press sagging 402 to form the proximal inner circumferential surfaces 431. This makes it possible to easily produce the proximal inner circumferential surfaces 431 in the packing 4.

As previously described, the first exemplary embodiment of the present disclosure provides the spark plug 1 having an improved structure, and the method of producing the spark plug 1 while suppressing the insulator 3 from being broken during the production of the spark plug 1.

Second Exemplary Embodiment

A description will be given of the spark plug and method of producing the spark plug according to a second exemplary embodiment of the present disclosure with reference to FIG. 11 and FIG. 12. The second exemplary embodiment provides the spark plug 1 having the packing 4 of the improved structure, and the method of producing the spark plug having the packing 4.

Figure 11:
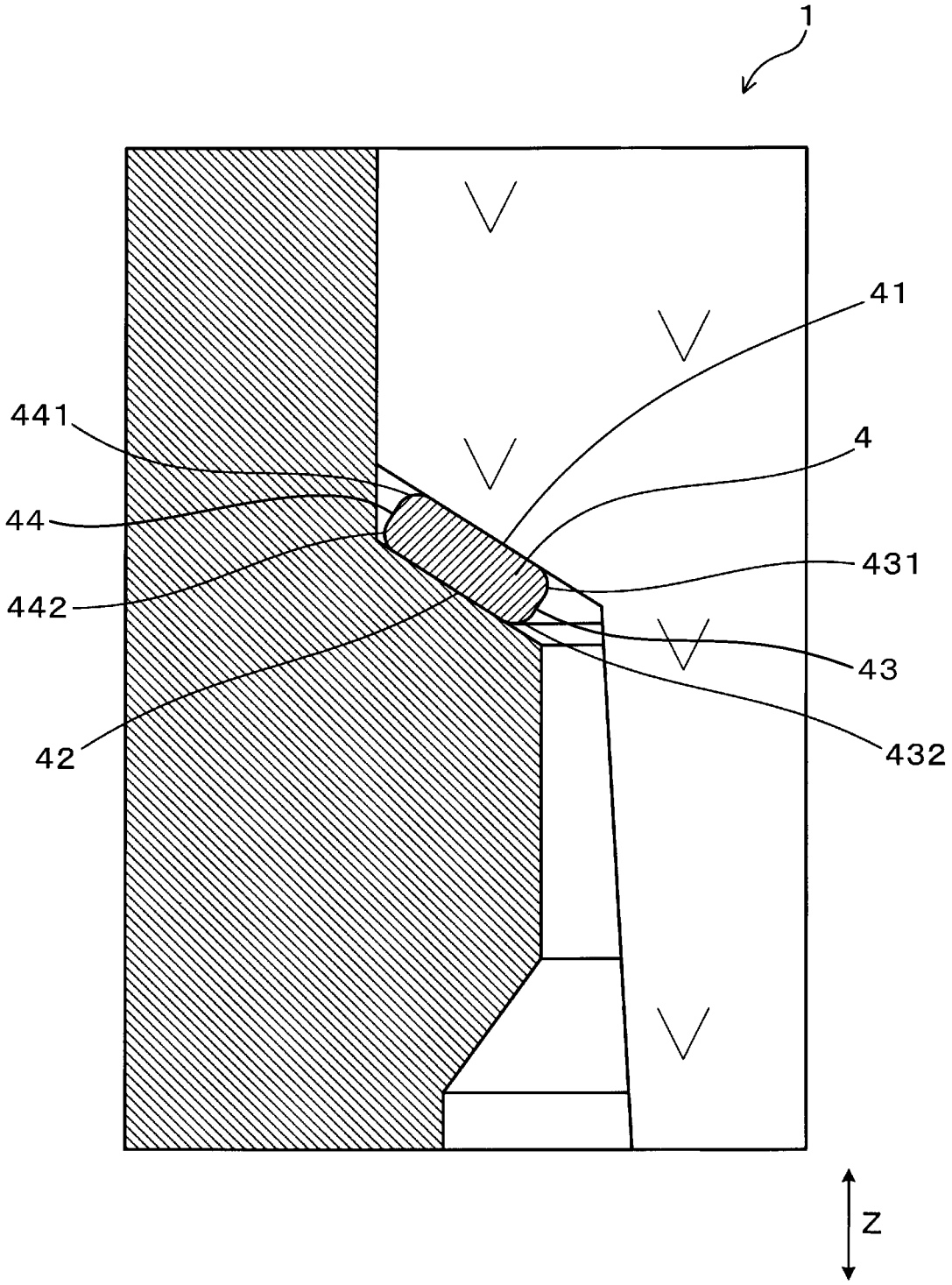
FIG. 11 is an enlarged view of the surrounding part of the packing in the spark plug produced by the method according to a second exemplary embodiment of the present disclosure.

FIG. 11 is an enlarged view of the surrounding part of the packing 4 in the spark plug 1 produced by the method according to the second exemplary embodiment of the present disclosure.

In the spark plug produced by the method according to the second exemplary embodiment, distal inner circumferential surfaces 432 are formed adjacent to the inner periphery side of the housing side contact surface 42, and distal outer circumferential surfaces 442 are formed adjacent to the outer periphery side of the housing side contact surface 42. Each of the distal inner circumferential surfaces 432 and the distal outer circumferential surfaces 442 has a curved surface which is smoothly connected to the housing side contact surface 42.

In the structure of the spark plug 1 according to the second exemplary embodiment shown in FIG. 11, the distal inner circumferential surface 432 is formed at the end part of the inner periphery side surface 43, i.e. at the housing side contact surface 42 side of the packing 4. The distal inner circumferential surface 432 has a curved surface of a chamfer at the proximal end side of the packing 4 in a diagonally inner circumferential direction.

Further, the distal outer circumferential surface 442 is formed at the end part of the outer periphery side surface 44, i.e. at the housing side contact surface 42 side of the packing 4. The distal outer circumferential surface 442 has a curved surface of a chamfer at the proximal end side of the packing 4 in a diagonally outer circumferential direction.

On a cross section of the packing 4 in a direction running on the central axis of the spark plug 1 and parallel to the plug axial direction Z, each of the distal inner circumferential surface 432 and the distal outer circumferential surface 442 has a curvature radius of not less than 5 μm. In particular, no burr line is formed in the packing 4 in the spark plug 1 according to the second exemplary embodiment. On the other hand, the packing 1 according to the first exemplary embodiment has the burr line 45 shown in FIG. 4. The other components of the spark plug 1 according to the second exemplary embodiment are the same as those of the spark plug according to the first exemplary embodiment.

A description will now be given of the method of producing the spark plug 1 according to the second exemplary embodiment with reference to FIG. 12.

Figure 12:
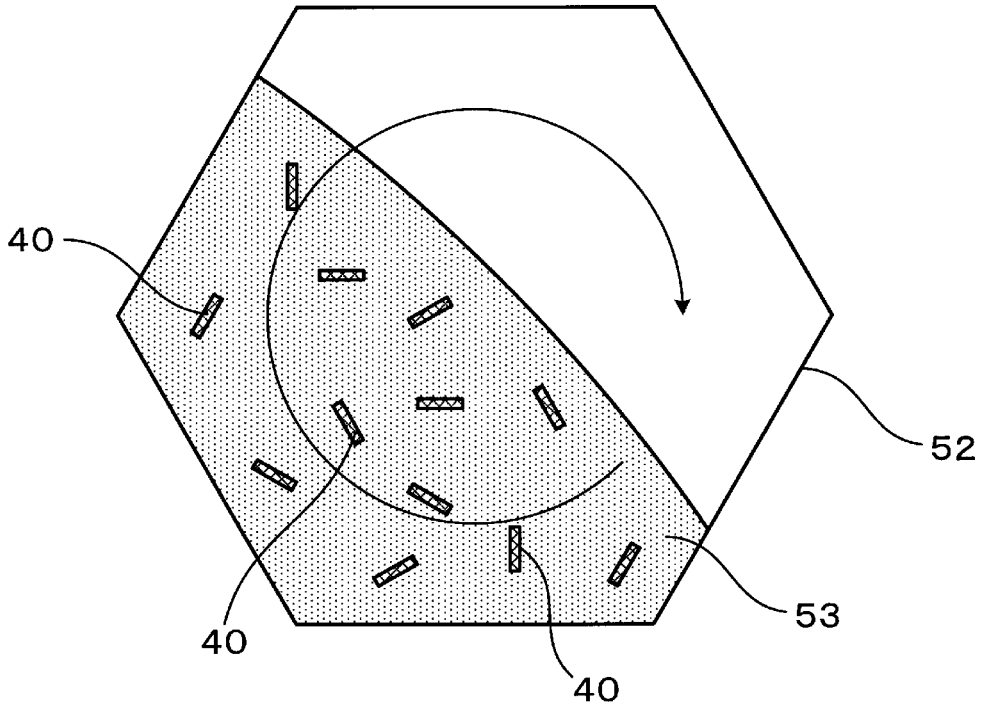
FIG. 12 is a view showing the method of producing the packing according to the second exemplary embodiment, in particular, showing a schematic view of a packing member and a method of polishing the packing member to form the packing in the spark plug.
Figure 13:
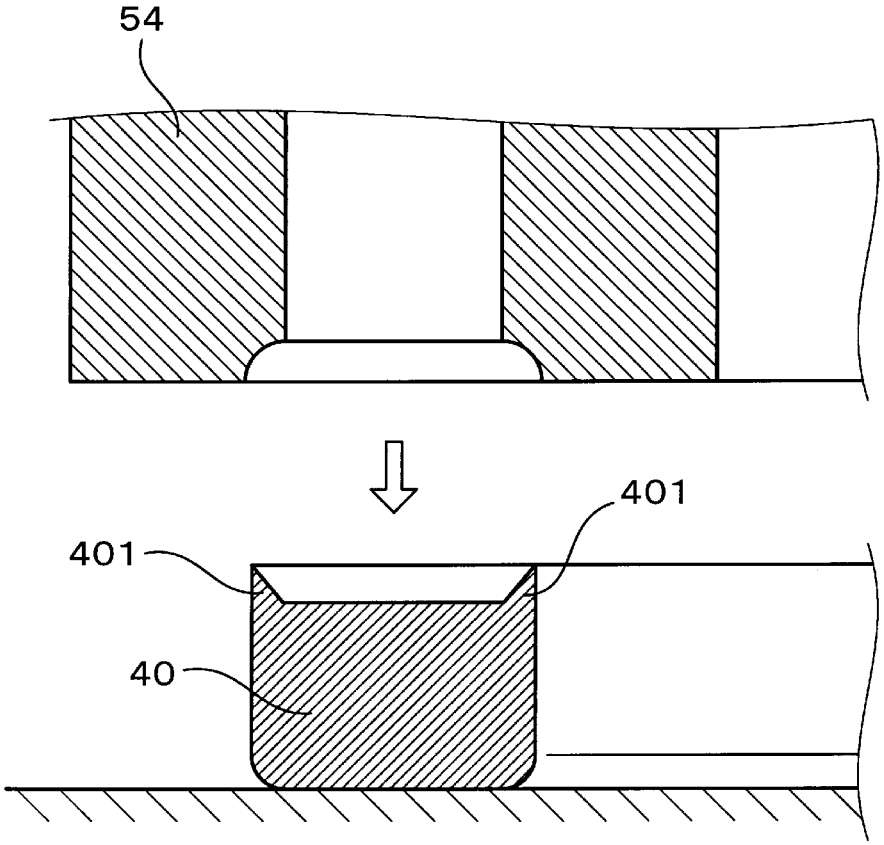
FIG. 13 is a view showing the method of producing the packing in the spark plug according to a third exemplary embodiment, in particular, showing the packing member and a surface pressing jig before pressing the packing member by using the surface pressing jig.

FIG. 12 is a view showing the method of producing the packing according to the second exemplary embodiment. In particular, FIG. 13 showing a schematic view a packing member 40 and the method of polishing the packing member 40 to form the packing 4 in the spark plug 1.

Similar to the punching step described in the first exemplary embodiment, the second exemplary embodiment performs the punching step of producing the packing member 40 having a ring shape. The press burrs 401 are formed in the packing member 40 (see FIG. 7). As previously described, the method according to the second exemplary embodiment produces the packing member 40, and assembles the produced packing member 40 as the packing 4 with the spark plug 1.

As shown in FIG. 12, before the assembling of the packing member 40 with the spark plug 1, the method performs a barrel polishing step of polishing the packing member 40 so as to form a curved surface on the corners of the packing member 40.

In the barrel polishing step, packing members 40 having press burrs 401 produced by the punching step are arranged in a barrel 52 as a bowl shaped container. A fluid part 53 is arranged in the barrel 52. The fluid part 53 is composed of water and polishing materials.

The fluid part 53 is rotated in the barrel 53 so as to contact the packing members 40 and the polishing materials in the barrel 53. This step rounds the corners of the packing members 40, and produces the packings 4 having a ring shape and rounded corners.

The method arranges the packing 4 produced previously described between the housing facing surface 21 of the housing 2 and the insulator 3. Similar to the method according to the first exemplary embodiment, the method according to the second exemplary embodiment produces the spark plug 1 with the packing 4.

The same reference numbers and characters between the second exemplary embodiment and the first exemplary embodiment represent the same components, and the explanation of the same components is omitted here for brevity.

A description will be given of behavior and effects of the spark plug and method according to the second exemplary embodiment.

In the structure of the spark plug 1 according to the second exemplary embodiment, each of the four corners of the packing 4 on a cross section of the packing 4 in a direction parallel with the plug central axis, i.e. each of the proximal inner circumferential surfaces 431, the proximal outer circumferential surface 441, the distal inner circumferential surface 432 and the distal outer circumferential surface 442 has a curved surface which is smoothly connected to the housing side contact surface 42.

In this structure of the spark plug 1, each of the distal inner circumferential surface 432 and the distal outer circumferential surface 442 has a curved surface, and is arranged adjacent to the insulator side contact surface 41 in the packing 4 irrespective of the arrangement direction of the packing 4 viewed from the plug axial direction Z.

This makes it possible to reduce the force applied from the packing 4 to the insulator 3 without considering the arrangement direction of the packing 4 to the housing 2. Accordingly, it is possible for the method according to the second exemplary embodiment to improve the productivity of the spark plug 1.

The method of producing the spark plug 1 according to the second exemplary embodiment performs the barrel polishing step of polishing the packing member 40. After the barrel polishing step, each of the four corners of the packaging member 40, i.e. each of the proximal inner circumferential surfaces 431, the proximal outer circumferential surface 441, the distal inner circumferential surface 432 and the distal outer circumferential surface 442 has a curved surface. It is accordingly for the method according to the second exemplary embodiment to easily produce the packing 4 having the structure in which the overall corner parts, i.e. the proximal inner circumferential surfaces 431, the proximal outer circumferential surface 441, the distal inner circumferential surface 432 and the distal outer circumferential surface 442 have a curved surface. This increases the productivity of the spark plug 1. The spark plug and method according to the second exemplary embodiment have the same behavior and effects of the spark plug and method according to the first exemplary embodiment.

It is possible for the second exemplary embodiment to use various known barrel polishing methods of polishing the packing member 40. For example, as known barrel polishing methods, there are a fluid type polishing method, a centrifugal force type polishing method, a rotary type polishing method, a vibration type polishing method, etc.

It is further possible for the second exemplary embodiment to use a dry type barrel polishing method without using water, instead of using a wet type barrel polishing method using the barrel 53 filled with water.

A description will be given of experimental results and evaluation results regarding the strength of the insulator in first to fourth test sample groups G1 to G4 as spark plugs. Those test sample groups G1 top G4 included various types of spark plugs which have a different shape of the proximal inner circumferential surfaces 431.

The experiment prepared the four test sample groups, i.e. the first to fourth test sample groups G1 to G4 composed of spark plugs having the proximal inner circumferential surfaces 431 of a different shape. The spark plugs in the first to fourth test sample groups G1 to G4 were produced by a different production method.

The packing 4 in each of the spark plugs belonging to the first test sample group G1 was produced by the punching step substantially equal to the punching step described in the first exemplary embodiment. In the production of the spark plugs in the first test sample group G1, the packing 4 was assembled with the housing 2 while the press burrs in the packing were arranged facing the insulator facing surface 31 of the insulator 3. In the first test sample group G1 before the assembling step with the housing 2 after the punching step, each proximal inner circumferential surface 431 of the packing 4 had the press burr which had a press burr height of 5 μm in the plug axial direction Z.

The packing 4 in each of the spark plugs belonging to the second test sample group G2 was produced by the same punching step and barrel polishing step as the punching step and barrel polishing step performed by the second exemplary embodiment.

In the production of the spark plugs belonging to the second test sample group G2, after the punching steps, the press burrs of the packing were polished by the barrel polishing step so as to have the corners of a curvature radius of 0 μm. After the barrel polishing step, the packing 4 was assembled with the housing 2 while the press burrs having the corners of the curvature radius of 0 μm were arranged facing the proximal inner circumferential surface 431 of the insulator 4. The packings in the spark plugs belonging to the second test sample group G2 had the proximal inner circumferential surface 431 which had the curvature radius of 0 μm.

The packing 4 in each of the spark plugs belonging to the third test sample group G3 was produced by the same production method as the second exemplary embodiment. In particular, the production method of producing the spark plugs in the third test sample groups G3 performed the barrel polishing step during a time period which was different from, i.e. longer than the time period of the barrel polishing step of polishing the spark plugs belonging to the second test sample group G2. The spark plugs belonging to the third test sample groups G3 has the press burrs having a curved surface having a curvature radius of 5 μm.

After the barrel polishing step, the packing 4 was assembled with the housing 2 while the press burrs having the curvature radius of 5 μm were arranged facing the proximal inner circumferential surface 431 of the insulator 4. The packings 4 in the spark plugs belonging to the third test sample group G3 had the proximal inner circumferential surface 431 having the curvature radius of 5 μm.

The packing 4 in each of the spark plugs belonging to the fourth test sample group G4 was produced by the same production method as the second exemplary embodiment. In particular, the production method of producing the spark plugs belonging to the fourth test sample groups G4 performed the barrel polishing step during a time period which was different from, i.e. longer than the time period of the barrel polishing step of polishing the spark plugs belonging to the third test sample group G3.

The spark plugs belonging to the third test sample groups G4 has the press burrs having a curved surface having a curvature radius of 10 μm.

After the barrel polishing step, the packing 4 was assembled with the housing 2 while the press burrs having the curvature radius of 10 μm were arranged facing the proximal inner circumferential surface 431 of the insulator 4. The packings 4 in the spark plugs belonging to the third test sample group G4 had the proximal inner circumferential surface 431 having the curvature radius of 10 μm.

The experiment prepared hundred test samples (spark plugs) for each of the first to fourth test sample groups G1 to G4. That is, the experiment performed the punching step so as to produce each of the test samples as the spark plug having 0.4 mm thickness, 6.6 mm inner diameter and 7.6 mm outer diameter.

The experiment performed the test of each test sample on the basis of ISO 11565 (ISO: International Organization for Standardization). Specifically, each test sample as the spark plug was fixed so that the plug axial direction Z of each test sample was arranged to be aligned with a horizontal direction. The experiment pressed a location 1 mm from the proximal end side of the insulator measured from the distal end surface (i.e. from the front end surface) of the insulator in the center of the plug radial direction by 10 mm/min. Further, the experiment detected a breaking load [N] at a time when being applying to the insulator when the insulator was just broken. The experiment performed the test at the room temperature.

Finally, the experiment disassembled each test sample and performed a visible dye penetration test, i.e, a red check so as to detect whether or not each test sample had been fractured.

The experiment detected whether a breakage weight of each test sample is not less than 600 N or less than 600 N. When no test sample belonging to each of the first to fourth test sample groups G1 to G4 has the breakage weight of less than 600 N, the evaluation result A is provided to this test sample group. On the other hand, when at least one of 100 test samples belonging to each of the first to fourth test sample groups G1 to G4 has the breakage weight of less than 600 N, The evaluation result B is provided to this test sample group.

Table 1 shows the experimental results of the test samples belonging to each of the first to fourth test sample groups G1 to G4. In Table 1, Press burr height [μm] represents a height of press burrs, in the plug axial direction Z, formed at the proximal inner circumferential surface 431 in the packing 4 in each test sample. Curvature radius [μm] represents a curvature radius of the proximal inner circumferential surface 431 in each test sample belonging to the second to fourth test sample groups G2 to G4 after the punching step. Also shown are the ratio of the number of test samples having a breaking load of less 600 N in 100 test samples belonging to each test sample group, and an evaluation result representing an evaluation of a strength of the insulator in each of the first to fourth test sample groups G1 to G4.

TABLE 1

| | Press burr height [μm] | Radius Curvature [μm] | Ratio of number of test samples having breaking load of less 600N in 100 test samples of each test sample group | Evaluation results |
|---|---|---|---|---|
| First test sample group G1 | 5 | — | 40/100 | B |
| Second test sample group G2 | — | 0 | 2/100 | B |
| Third test sample group G3 | — | 5 | 0/100 | A |
| Fourth test sample group G4 | — | 10 | 0/100 | A |

As can be understood from the evaluation results shown in Table 1, when a test sample has press burrs (i.e. the test samples belonging to the first test sample group G1), formed at the proximal inner circumferential surface 431, having a press burr height of 5 μm in the plug axial direction Z before the assembling step with the housing 2 after the punching step, 40 test samples in the overall 100 test samples in the first test sample group G1 have the breaking load of less than 600 N. It can be understood that the formation of press burrs formed at the proximal inner circumferential surface 431 often causes a breakage of the insulator in the spark plug.

As can be understood from the evaluation results shown in Table 1, when a test sample having the packing 4 in which the proximal inner circumferential surface 431 has a curvature radius of 0 μm (i.e. has a sharp shape), two test samples in the overall 100 test samples belonging to the second test sample group G2 have the breaking load of less than 600 N. Accordingly, it can be understood that there is a risk of breakage of the insulator in a spark plug when the proximal inner circumferential surface 431 in the packing 4 has a curvature radius of 0 μm (i.e. has a sharp shape).

On the other hand, as can be clearly understood from the evaluation results shown in Table 1, when a test sample has the packing 4 in which the proximal inner circumferential surface 431 has a curvature radius of not less than 5 μm, the overall 100 test samples belonging to the third and fourth test sample groups G3 and G4 have the breaking load of not less than 600 N. Accordingly, it can be understood that it is possible to prevent the insulator from being broken when the proximal inner circumferential surface 431 in the packing 4 has a curvature radius of not less than 5 μm.

The experiment provides that it is difficult to produce the proximal inner circumferential surface 431 having the curvature radius of 20 μm or more. It is preferable for the spark plug to have the packing 4 in which the proximal inner circumferential surface 431 has the curvature radius of not more than 20 μm.

Third Exemplary Embodiment

A description will be given of the spark plug and method of producing the spark plug according to a third exemplary embodiment of the present disclosure with reference to FIG. 13 and FIG. 14.

The third exemplary embodiment provides the spark plug and method of producing the packing 4 in the spark plug.

FIG. 13 is a view showing the method of producing the packing in the spark plug according to the third exemplary embodiment. In particular, FIG. 13 shows the packing member 40 and a surface pressing jig 54 before pressing the packing member 40 by using the surface pressing jig 54. FIG. 14 is a view showing the method of producing the packing according to the third exemplary embodiment. In particular, FIG. 14 shows the packing member 40 with burr lines, designated by the reference number 45 shown in FIG. 4, formed by pressing the press burrs 401 shown in FIG. 13 on the surface of the packing member.

Figure 14:
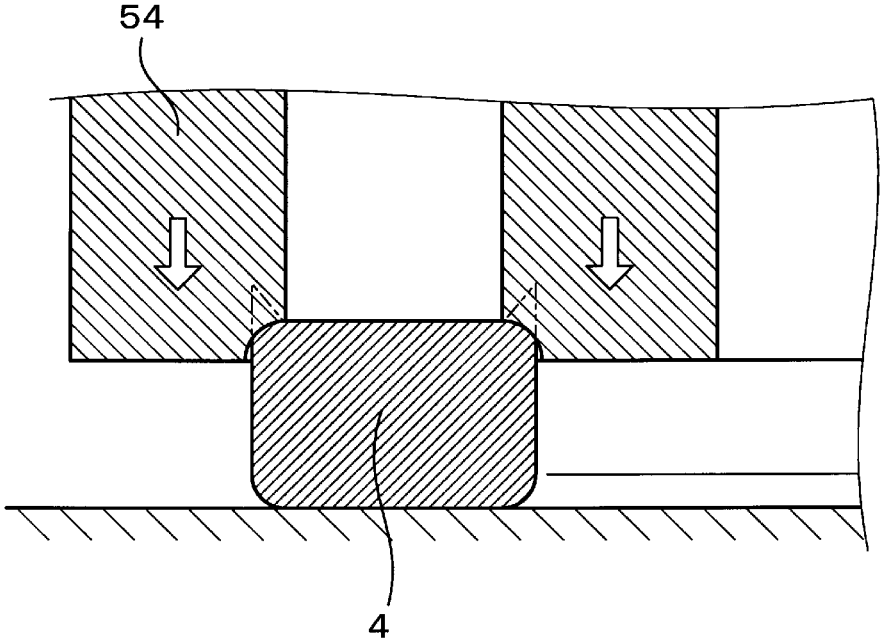
FIG. 14 is a view showing the method of producing the packing according to the third exemplary embodiment, in particular, showing the packing member with burr lines formed by pressing the press burrs shown in FIG. 13 on the surface of the packing member.

As shown in FIG. 13 and FIG. 14, the method according to the third exemplary embodiment provides the spark plug 4 having the packing 4 in which the burr lines 45 (see FIG. 4) are formed. On the other hand, as previously described, the method according to the second exemplary embodiment provides the spark plug 4 having the packing 4 without any burr line. Other components of the spark plug according to the third exemplary embodiment have the same structure as the spark plug according to the second exemplary embodiment.

Similar to the method according to the first and second exemplary embodiments, the punching step punches the packing member 40 to have a ring shape. As shown in FIG. 13, the punching step generates press burrs 401 in the packing member 40.

After the completion of the punching step, the method according to the third exemplary embodiment performs a pressing step which presses the surface of the press burrs 401, formed on the packing member 40, by using the surface pressing jig 54. The surface pressing step deforms the press burrs 401 formed on the corners of the packing member 40, and forms a curved surface at each corner of the packing member 40 so that each corner of the packing member 40 has a curved surface. The method according to the third exemplary embodiment performs the remaining steps which are the same steps as the second exemplary embodiment.

As previously described, the surface pressing step presses the press burrs 401 formed at the corners of the packing member 40. This step forms the burr lines 45 (see FIG. 4) on the inner circumferential edge parts and the outer circumferential edge part at which the press burrs 401 have been formed.

In the production of the spark plug 1 according to the third exemplary embodiment, the burr lines 45 are covered with plating by a plating step after the surface pressing step. The burr lines 45 have been remained inside the plating. It is accordingly possible to easily detect the presence of the bur lines 45 formed in the packing 4 by observing a cross section of the packing 4 in the spark plug 1.

Other behavior and effects of the spark plug and method according to the third exemplary embodiment are the same as those according to the second exemplary embodiment previously described.

Fourth Exemplary Embodiment

A description will be given of the spark plug and method of producing the spark plug according to a third exemplary embodiment of the present disclosure with reference to FIG. 15 and FIG. 19.

The fourth exemplary embodiment provides the spark plug and method of producing the spark plug 1.

A description will be given of the method of producing the packing 4 according to the fourth exemplary embodiment.

Figure 15:
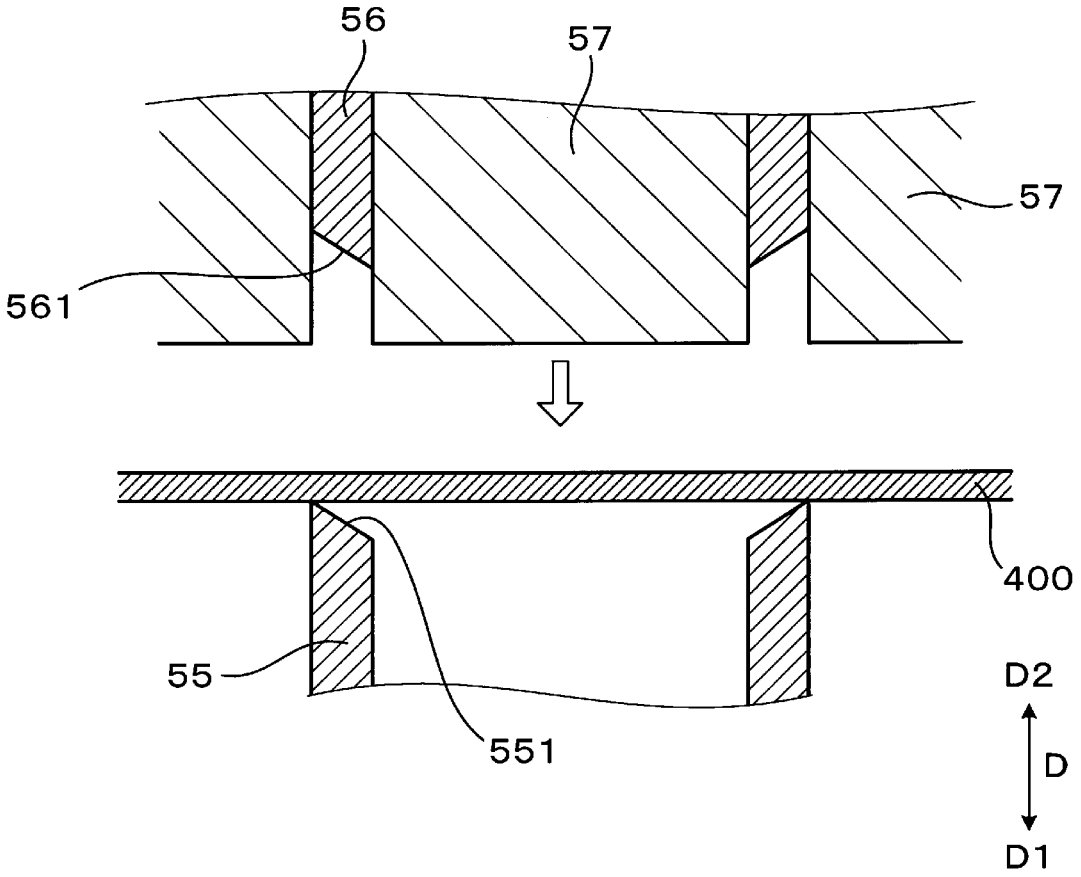
FIG. 15 is a view showing a packing formation step composed of a first formation step and a second formation step according to a fourth exemplary embodiment of the present disclosure.

FIG. 15 is a view showing a packing formation step composed of a first formation step and a second formation step according to the fourth exemplary embodiment. In particular, FIG. 15 shows the plate member 400 arranged on a first forming die 55 before the punching. The packing formation step uses the first forming die 55, a second forming die 56 and a punching tool 57.

The first forming die 55 has a cylindrical shape. The punching tool 57 is formed to be inserted inside the first forming die 55. The second forming die 56 is arranged facing the first forming die 55 in a formation direction D of the first forming die 55 shown in FIG. 15. The second forming die 56 also has a cylindrical shape. The formation direction D of the first forming die 55 coincides with the penetration direction of the inside chamber of the first forming die 55.

The first forming die 55 has a first facing surface 551 of a tapered shape. The second forming die 56 has a second facing surface 561 of a tapered shape. Each of the first facing surface 551 of the first forming die 55 and the second facing surface 561 of the second forming die 56 is formed to be inclined in the inner periphery side thereof at a first direction D1 side of the formation direction D shown in FIG. 15.

The packing formation step has a first formation step and a packing formation step.

Figure 16:
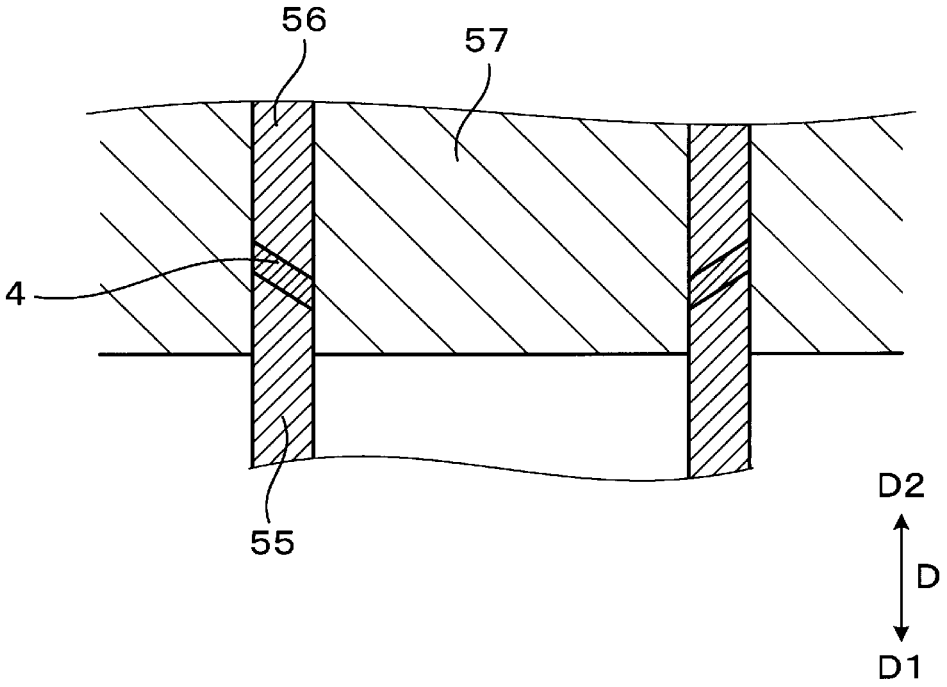
FIG. 16 is a view showing the second formation step in the packing formation step according to the fourth exemplary embodiment, in particular, showing a cross section of the packing in the second formation step after the first formation step.

As shown in FIG. 15, the first formation step arranges the plate member 400 for the packing 4 at a second direction D2 side of the first forming die 55 in a thickness direction of the plate member 400 to coincide with the formation direction D of the first forming die 55. FIG. 16 is a view showing the second formation step of the packing formation step according to the fourth exemplary embodiment. In particular, FIG. 16 shows a cross section of the packing 4 in the second formation step after the first formation step according to the fourth exemplary embodiment.

As shown in FIG. 16, the punching tool 57 punches the part of the plate member 400, arranged on the first formation die 55, at the inner periphery side and the outer periphery side of the first forming die 55 in the first direction D1 side from the second direction D2 side of the first forming die 55. The first formation step produces the packing member 40 having a ring shape. The produced packing member 40 is arranged between the first facing surface 551 of the first forming die 55 and the second facing surface 561 of the second forming die 56 which are arranged facing from each other.

In the second formation step, the packing member 40 is arranged between, i.e. pinched by the first facing surface 551 of the first forming die 55 and the second facing surface 561 of the second forming die 56, and the second forming die 56 pushes the packing member 40 in the first forming die 55 side. The second formation step thereby produces the packing 4 having a tapered shape which is tapered inwardly in the first direction D1 of the second facing surface 561 of the second forming die 56.

Figure 17:
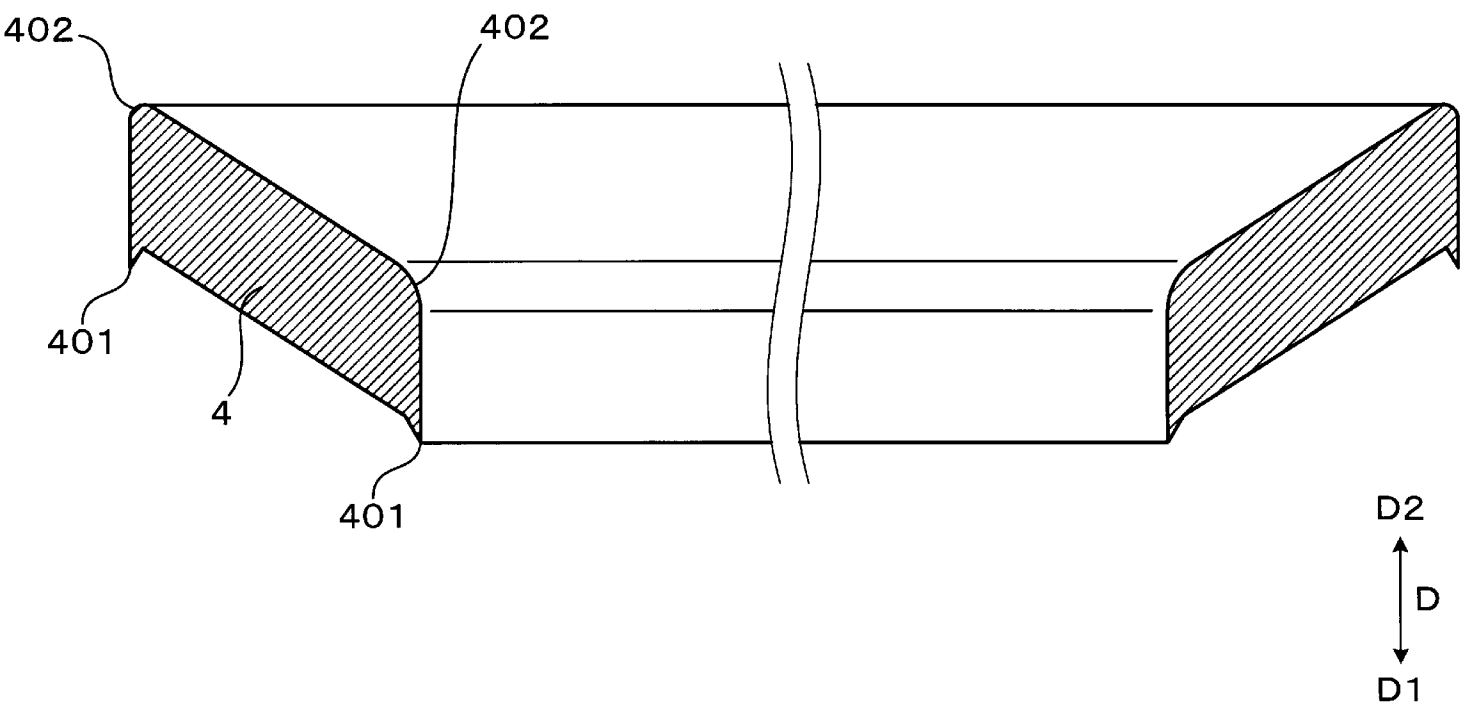
FIG. 17 is a view showing the packing produced by the packing formation step according to the fourth exemplary embodiment of the present disclosure.

FIG. 17 is a view showing the packing 4 produced by the packing formation step according to the fourth exemplary embodiment of the present disclosure. As shown in FIG. 17, the packing formation step produces the packing 4, and the packing 4 has the press burrs 401 which are formed at the inner circumferential edge part and the outer circumferential edge side and project in the first direction D1 side of the formation direction D. Further, packing 4 has the press sagging 402 at the inner circumferential edge and the outer circumferential edge at the second direction D2 side.

A description will now be given of the assembling step of assembling the packing 4 with the spark plug 1 with reference to FIG. 18 and FIG. 19.

Figure 18:
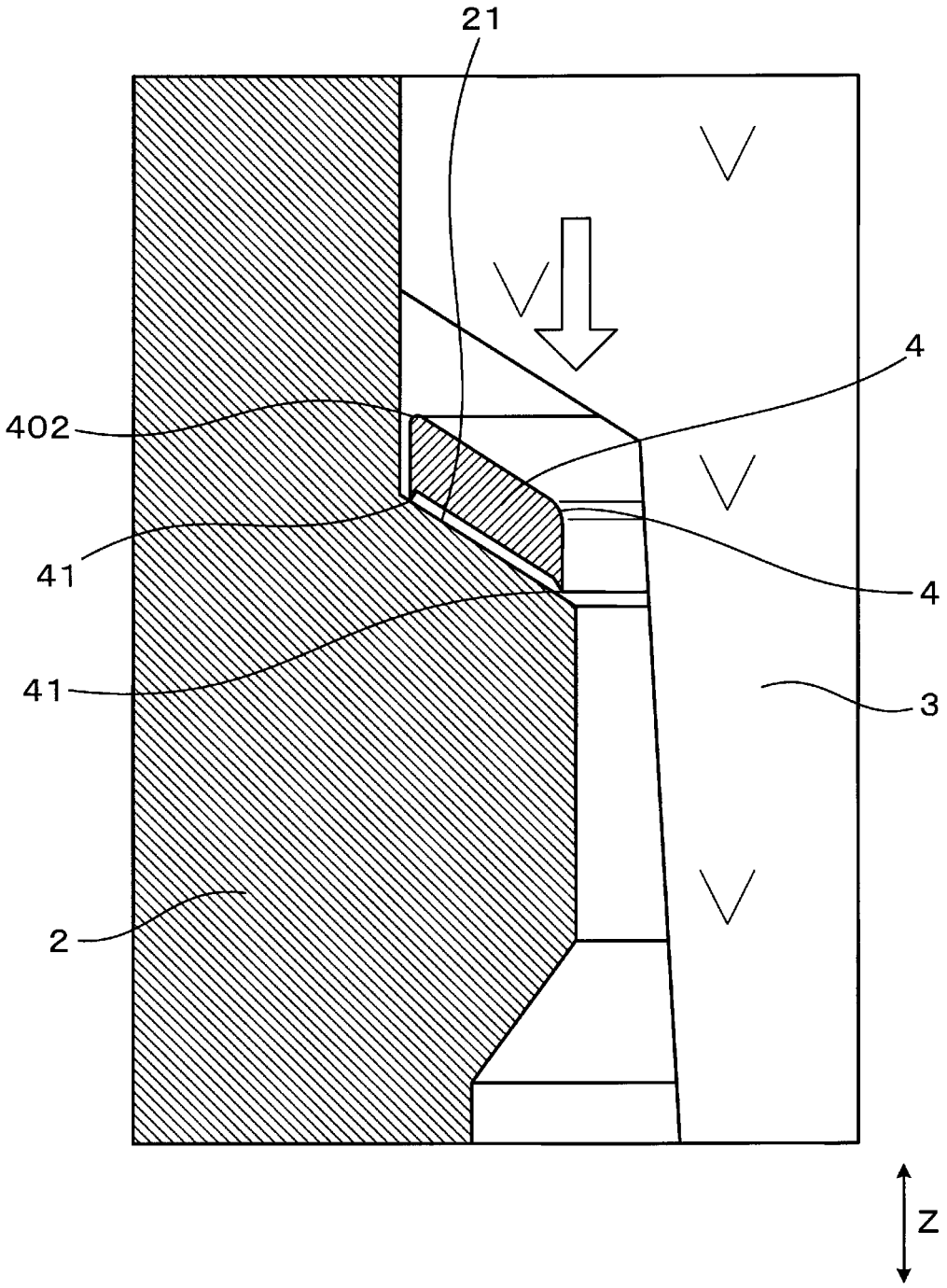
FIG. 18 is a view showing the method of assembling the packing with the housing and the insulator in the spark plug according to the fourth exemplary embodiment, in particular, showing a partially enlarged cross section of a structure in which the packing is arranged between the housing and the insulator in the spark plug according to the first exemplary embodiment.

FIG. 18 is a view showing the method of assembling the packing 4 with the housing 2 and the insulator 3 in the spark plug 1 according to the fourth exemplary embodiment. In particular, FIG. 18 shows a partially enlarged cross section of a structure in which the packing 4 are arranged between the housing 2 and the insulator 3 in the spark plug 1 according to the first exemplary embodiment.

As shown in FIG. 18, the packing 4 is arranged at the housing facing surface 21 of the housing 2 so that the press burrs 401 of the packing 4 face the housing facing surface 21 side, and the press sagging 402 of the packing 4 faces the opposite (i.e. the proximal end side) of the housing facing surface 21 side.

Figure 19:
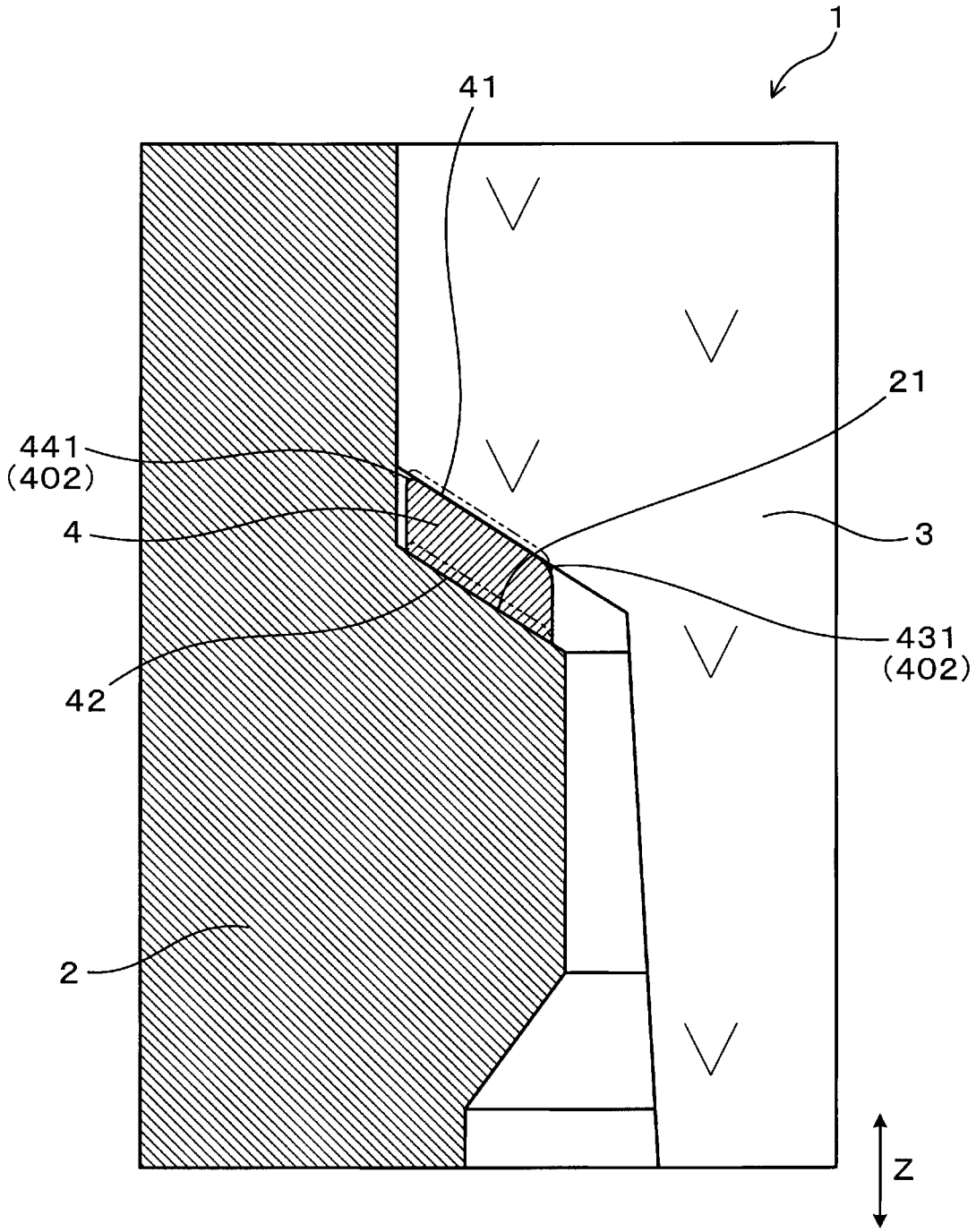
FIG. 19 is a view showing the method of producing the spark plug according to the fourth exemplary embodiment, in particular, showing a partially enlarged cross section of the spark plug in which the packing is deformed between the housing and the insulator by an assemble step according to the fourth exemplary embodiment.

FIG. 19 is a view showing the method of producing the spark plug 1 according to the fourth exemplary embodiment. In particular, FIG. 19 shows a partially enlarged cross section of the spark plug 1 in which the packing 4 is deformed between the housing 2 and the insulator 3 by an assemble step according to the fourth exemplary embodiment.

As shown in FIG. 19, the insulator 3 is inserted from the proximal end side of the housing 2 into the housing 2. Similar to the method according to the first exemplary embodiment previously described, the method according to the fourth exemplary embodiment performs the pressing step of pressing the insulator 3 to the housing 2 side so as to deform the packing 4 between the housing 2 and the insulator 3. That is, this pressing step forms the insulator side contact surface 41 of the packing 4 which is in contact with the insulator facing surface 31 of the insulator 3. Further, this pressing step presses the press sag 402, formed adjacent to the inner periphery side of the insulator side contact surface 41, so as to form the proximal inner circumferential surface 431 having a curved shape. Further, this pressing step presses the press sag 402, formed adjacent to the outer periphery side of the insulator side contact surface 41, so as to form the proximal outer circumferential surface 441 having a curved shape.

The press burrs 401 formed at the distal end side of the packing 4 is pressed and deformed by the housing facing surface 21 of the housing 2. This pressing step further forms the burr lines 45 (see FIG. 4, for example) along the overall inner circumferential and outer circumferential of the housing side contact surface 42 of the packing 4.

As previously described, the packing 4 is assembled with the spark plug 1. The production of the spark plug 1 according to the fourth exemplary embodiment is completed.

Next, a description will be given of behavior and effects of the spark plug 1 and the method according to the fourth exemplary embodiment.

In the first formation step of the production of the spark plug 1 according to the fourth exemplary embodiment, the punching tool 57 punches the part of the plate member 400, arranged on the first formation die 55, at the inner periphery side of the first forming die 55 in the first direction D1 side from the second direction D2 side of the first forming die 55. The first formation step produces the press burrs 401 projecting in the first direction D1 side on the plate member 400.

In the second formation step after the first formation step, the plate member 400 is arranged in the formation direction D between the first forming die 55 and the second forming die 56 shown in FIG. 15. The first forming die 55 and the second forming die 56 produces the packing 4 having a tapered shape which is tapered in the inner periphery side along the first direction D1 shown in FIG. 16.

Accordingly, it is possible to recognize the projection direction of the press burrs 401 on the basis of the tapered direction of the tapered shape of the packing 4 after the first formation step and the second formation step. Although the press burrs 401 have a small size, it is possible to easily recognize that the press burrs 401 are formed in the packing 4 after the first formation step and the second formation step, i.e. to easily recognize that the press burrs 401 are formed inwardly in the reduced diameter side, i.e. to the first direction D1 side.

Accordingly, it is possible to prevent the press burrs 401 of the packing 4 from being arranged in the insulator facing surface 31 side, i.e. possible to easily and correctly arrange the packing 4 between the housing facing surface 21 of the housing 2 and the insulator facing surface 31 of the insulator 3.

In addition to the behavior and effects previously described, the spark plug and method according to the fourth exemplary embodiment have the same behavior and effects as those of the first exemplary embodiment.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug, comprising:

a housing having a cylindrical shape comprising a housing facing surface;

an insulator having a cylindrical shape comprising an insulator facing surface, the insulator being supported in the housing; and a packing comprising an insulator side contact surface formed in contact with the insulator facing surface of the insulator, wherein the packing is arranged between the housing facing surface of the housing and the insulator facing surface of the insulator so as to face both the housing facing surface and the insulator facing surface, the cylindrical packing is comprised of a press-punched plate member that has already formed an inner circumferential press-sagging surface and an outer circumferential press-sagging surface, and each of the inner and outer press-sagging surfaces having a curved shape so as to be smoothly connected to the insulator facing surface of the insulator.

2. The spark plug according to claim 1, wherein on a cross section of the packing in a direction parallel with a plug axial direction of the spark plug passing through a central axis of the packing, each of the proximal inner circumferential surfaces of the packing has a curvature radius of not less than 5 μm.

3. The spark plug according to claim 1, wherein the packing further comprises a housing side contact surface arranged in contact with the housing facing surface of the housing, and burr lines are formed at inner periphery side edges of the housing side contact surface of the packing along a plug circumferential direction.

4. The spark plug according to claim 2, wherein the packing further comprises a housing side contact surface arranged in contact with the housing facing surface of the housing, and burr lines are formed at inner periphery side edges of the housing side contact surface of the packing along a plug circumferential direction.

5. The spark plug according to claim 1, wherein the packing further comprises proximal outer circumferential surfaces formed adjacently at an outer periphery side of the insulator side contact surface, and each of the proximal outer circumferential surfaces has a curved shape which is smoothly connected to the insulator side contact surface of the packing.

6. The spark plug according to claim 2, wherein the packing further comprises proximal outer circumferential surfaces formed adjacently at an outer periphery side of the insulator side contact surface, and each of the proximal outer circumferential surfaces has a curved shape which is smoothly connected to the insulator side contact surface of the packing.

7. The spark plug according to claim 3, wherein the packing further comprises proximal outer circumferential surfaces formed adjacently at an outer periphery side of the insulator side contact surface, and each of the proximal outer circumferential surfaces has a curved shape which is smoothly connected to the insulator side contact surface of the packing.

8. The spark plug according to claim 5, wherein each of distal inner circumferential surfaces formed adjacent to an inner periphery side of a housing side contact surface and distal outer circumferential surfaces formed adjacent to an outer periphery side of the housing side contact surface has a curved surface which is smoothly connected to the housing side contact surface.

9. The spark plug according to claim 6, wherein each of distal inner circumferential surfaces formed adjacent to an inner periphery side of a housing side contact surface and distal outer circumferential surfaces formed adjacent to an outer periphery side of the housing side contact surface has a curved surface which is smoothly connected to the housing side contact surface.

10. The spark plug according to claim 7, wherein each of distal inner circumferential surfaces formed adjacent to an inner periphery side of the housing side contact surface and distal outer circumferential surfaces formed adjacent to an outer periphery side of the housing side contact surface has a curved surface which is smoothly connected to the housing side contact surface.

11. A method of producing the spark plug according to claim 1, comprising:

punching a plate member to produce the cylindrical packing that has already formed the inner circumferential press-sagging surface and the outer circumferential press-sagging surface, each of the inner and outer press-sagging surfaces having the curved shaped; and arranging the cylindrical packing between the housing facing surface of the housing and the insulator facing surface of the insulator so as to face both the housing facing surface and the insulator facing surface while:

press burrs formed by the step of punching the plate member are arranged at the housing facing surface side, and the curved inner and outer circumferential sagging surfaces that has been already formed by the step of punching the plate member are arranged at the insulator facing surface side; and pressing the insulator in the housing through the packing in a distal end direction of the spark plug so that the curved inner and outer circumferential sagging surfaces are smoothly contacted to the insulator facing surface of the insulator.

12. The method according to claim 11, wherein the step of punching the plate member to produce the cylindrical packing uses a first forming die having a cylindrical shape, a punching tool to be inserted inside the first forming die, and a second forming die having a cylindrical shape to be arranged facing the first forming die in a formation direction of the first forming die, a first facing surface of the first forming die has a tapered shape formed inwardly along a first direction of the formation direction, and a second facing surface of the second forming die has a tapered shape formed inwardly along a second direction of the formation direction, the first direction is in opposite to the second direction, the first facing surface of the first forming die and the second facing surface of the second forming die are arranged facing from each other in the formation direction of the first forming die, the step of punching the plate member comprises a first punching step and a second punching step, wherein in the first punching step, the punching tool punches a part at an inner periphery side of the plate member in the second direction from the first direction of the first forming die so as to produce a packing member, and in the second punching step, the packing member is arranged between the first facing surface of the first forming die and the second facing surface of the second forming die, and the second forming die pushes the packing member in the first forming die to produce the cylindrical packing having a tapered shape which is tapered inwardly in the first direction of the second facing surface of the second forming die.

13. A method of producing the spark plug according to claim 5, comprising:

punching a plate member to produce the cylindrical packing member having a ring shape; and performing a barrel polishing so as to polish the cylindrical packing member having proximal inner circumferential surfaces of a curved shape, proximal outer circumferential surfaces of a curved shape, distal inner circumferential surfaces of a curved shape, and distal outer circumferential surfaces of a curved shape.

* * * * *